US008447223B2

(12) United States Patent
Inui

(10) Patent No.: US 8,447,223 B2
(45) Date of Patent: May 21, 2013

(54) SHEET CONVEYING APPARATUS WITH INCLINED SURFACE AGAINST WHICH THE SHEET ABUTS AND IMAGE FORMING APPARATUS HAVING SAME

(75) Inventor: Fumiki Inui, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 1027 days.

(21) Appl. No.: 12/260,398

(22) Filed: Oct. 29, 2008

(65) Prior Publication Data

US 2009/0110457 A1 Apr. 30, 2009

(30) Foreign Application Priority Data

Oct. 31, 2007 (JP) ..... 2007-284447

(51) Int. Cl.
*B65H 9/16* (2006.01)
*B65H 9/00* (2006.01)
*B65H 85/00* (2006.01)

(52) U.S. Cl.
USPC ..... 399/401; 271/248; 271/250; 271/251; 399/395

(58) Field of Classification Search
USPC ..... 271/248, 249, 250, 251; 399/401, 399/395
See application file for complete search history.

(56) References Cited

U.S. PATENT DOCUMENTS

| | | | | |
|---|---|---|---|---|
| 6,402,139 | B1 * | 6/2002 | Kanno | 271/240 |
| 6,526,255 | B2 * | 2/2003 | Itoh et al. | 399/401 |
| 6,840,514 | B1 * | 1/2005 | Westhoff | 271/248 |
| 6,993,282 | B2 | 1/2006 | Kimizuka | 399/401 |
| 2004/0190964 | A1 | 9/2004 | Kimizuka | |
| 2007/0222144 | A1 * | 9/2007 | Inui et al. | 271/291 |
| 2007/0273092 | A1 * | 11/2007 | Inui | 271/251 |
| 2008/0296834 | A1 | 12/2008 | Matsubara et al. | 271/225 |

FOREIGN PATENT DOCUMENTS

| | | | |
|---|---|---|---|
| EP | 1469358 | A2 | 10/2004 |
| EP | 1469358 | A3 | 11/2004 |
| JP | 2000-233850 | | 8/2000 |
| JP | 3092986 | | 9/2000 |
| JP | 2004-299856 | | 10/2004 |
| JP | 2006111364 | A * | 4/2006 |
| JP | 2007091418 | A * | 4/2007 |
| JP | 3962701 | B2 | 8/2007 |

* cited by examiner

*Primary Examiner* — Daniel J Colilla
(74) *Attorney, Agent, or Firm* — Fitzpatrick, Cella, Harper & Scinto

(57) ABSTRACT

A sheet conveying apparatus has a reference guide in which a reference surface that is elongated in a sheet conveying direction and abuts against an end portion of a sheet, an inclined surface which is provided upstream of the reference guide and which is inclined in a width direction intersecting with the sheet conveying direction so that an edge of the sheet is guided, the inclined surface intersecting the reference guide at an intersection, a sheet guide portion, a passage portion having an upstream area which is wider than the sheet guide portion in a vertical direction, a downstream area which is narrower than the upstream area in a vertical direction, and an inclined guide which is provided between the inclined surface and the reference surface, wherein a position of an upstream edge of the downstream area is provided between the intersection and the oblique conveying unit.

6 Claims, 19 Drawing Sheets

SHEET CONVEYING APPARATUS WITH INCLINED SURFACE AGAINST WHICH THE SHEET ABUTS AND IMAGE FORMING APPARATUS HAVING SAME

BACKGROUND OF THE INVENTION

1. Field of the Invention

The present invention relates to a sheet conveying apparatus and an image forming apparatus.

2. Description of Related Art

A conventional example of an image forming apparatus such as an electro-photographic printer includes an image forming apparatus in which a sheet in which an image is formed on one surface is reversed and conveyed to an image forming portion again, thereby forming the image on back side of the sheet. Such an image forming apparatus has a sheet conveying apparatus which reverses the sheet in which the image is formed on one surface and conveys it to the image forming portion again.

In such a conventional sheet conveying apparatus, when the sheet is conveyed to the image forming portion again, the sheet may be skew-fed during conveyance. When the image is formed on back side, the sheet and the image may be shifted. This is because when the image is formed on a second surface (back side), a conveying path until the image is formed on the sheet is longer than that of a first surface, and thus the sheet is slightly shifted during conveyance depending on differences in eccentricity of various rollers and welding pressure or differences in resistance of the sheet conveying surface.

In order to prevent such a shifting of the sheet, it is necessary to adjust the position of the sheet so that the image and the sheet are matched until the image is formed on the second surface after forming the image on the first surface.

As an example of the method for adjusting the position of the sheet, there is listed a technique in which a reference guide is disposed at an end portion in a direction perpendicular to the sheet conveying direction of a reconveying passage (hereinafter referred to as the width direction) which conveys the sheet to the image forming portion again. There is a method in which alignment in the width direction of the sheet (hereinafter referred to as lateral register correction) is performed by conveying the sheet while pressing it against the reference guide (Japanese Patent Application Laid-Open (JP-A) No. 2000-233850).

FIG. 15 is a top perspective view illustrating the structure of the reconveying passage of the conventional sheet conveying apparatus having a lateral register correction portion that performs lateral register correction of the sheet by such a reference guide.

The lateral register correcting portion 23 has a reference guide 24 that includes a reference surface 24*a*, a pair of skew conveying rollers 11A that includes a skew conveying roller 11 and a skew conveying roller bearing (not shown), and a conveying lower guide 27. In this regard, the skew conveying roller bearing is disposed so as to be inclined toward the reference surface 24*a* at about 3 to 15° and has a drum-shaped form. Two reference surfaces 24*a* is rubbed by the sheet end portion when the sheet is fed. Thus, a plurality of reference pins 24*h*1 and 24*h*2 made of stainless steel having a cylindrical-shaped form are disposed in (pressed into) the reference surface in order to enhance them.

Subsequently, lateral register correcting operation of the lateral register correcting portion 23 having such a structure will be described.

As shown in FIG. 15(*a*), the sheet S in which an image is formed on one side is conveyed from a conveying roller 3*g* provided at upstream of the lateral register correcting portion 23 to the lateral register correcting portion 23. When the sheet S reaches the pair of skew conveying rollers 11A, the sheet S is then nipped and conveyed by the pair of skew conveying rollers 11A. Then, the sheet S is conveyed while it is drawn to the side of the reference surface 24*a* by the pair of skew conveying rollers 11A.

Subsequently, when the rear end of the sheet S is passed through the conveying roller 3*g*, the resistance of the conveying lower guide 27 allows the sheet to rotate so as to bring the rear end of the sheet close to the side of the reference surface 24*a* as shown in FIG. 15(*b*). Then, the sheet S abuts against a reference pin 24*h*1 by the rotation and the reaction force allows the edge of the sheet to rotate in a direction bringing it close to the side of the reference surface 24*a*.

As a result, the sheet S is aligned with the position along the reference surface 24*a* as shown in FIG. 15(*c*). Then, the sheet S that is thus subjected to lateral register correction by the lateral register correcting portion 23 is reconveyed to an image forming portion (not shown) via the intermediate roller 3*d*.

As described above, in the lateral register correcting portion 23, the resistance of the pair of skew conveying rollers 11A and the conveying lower guide 27 allows the sheet S to rotate and then the reference pin 24*h*1 serves as a pivot point to reverse the sheet S in order to move it along the reference surface 24*a*. As for the lateral register correction method, a conveying distance from the time the rear end of the sheet passes through the conveying roller 3*g* until it moves along the reference surface 24*a* is short and thus the efficiency of alignment (skew feeding correction) is good. Therefore, even when the duplex sheet is fed, a slight shifting of the sheet is corrected, thereby allowing the sheet to be reconveyed.

As shown in FIG. 16, the reference pins 24*h*1 and 24*h*2 disposed in the reference surface 24*a* of the reference guide 24 is projected out by only an 1 width toward the reference surface 24*a*. This prevents the sheet from abutting against the reference surface 24*a* directly. This can prevent the reference surface 24*a* from being worn out by sliding along the side edge of the sheet and further can prevent paper jams from occurring by the resistance rise in the sheet and the reference surface caused by wear when the sheet is fed (refer to Japanese Patent No. 3092986).

However, in such conventional sheet conveying apparatuses, shifting of the sheet may occur in the width direction (thrust direction) during conveyance of the sheet. When a lot of sheets are fed, the sheet is shifted by only a sheet width −X by variations of the attached position of a side regulating plate that regulates the side edge position of the sheet and variations of the alignment of each conveying roller, thereby causing the engine to be conveyed to the reference guide.

When the sheet is shifted by only the width −X in the width direction and conveyed to the reference guide, the sheet side edge directly abuts against a reference guide 24 in a sheet introducing area J at the upstream side by the reference pin 24*h*1 that serves as a pivot point shown in FIG. 16. In this case, the sheet side edge slides along the reference guides 24 and the sliding of the sheet causes wearing of the reference guide 24. Further, the wearing leads to sliding resistance between the sheet side edge and the reference guide 24, thereby causing paper jams easily. This becomes more remarkable as the duration of use becomes longer.

FIG. 17 is a diagram describing a state when the sheet S is shifted by the width −X and conveyed to the reference guide 24, FIG. 17(*a*) is a plain view at the time, and FIG. 17(*b*) is a cross-sectional view when a state at the time is viewed from the downstream in a sheet conveying direction. In this regard, the cross section of the reference guide 24 has a U-shaped form as shown in FIG. 17(*b*).

Here, in FIG. 17(*a*), a sheet introducing portion 24*b* is provided at the upstream side of the reference guide 24 and guides the sheet S being conveyed in the direction of an arrow B by the conveying roller 3*g* and a conveying lower guide 127 is arranged in parallel to the reference guides 24 and includes the undersurface (bottom surface) of the reconveying passage. In this regard, a controlling portion member 127*a* that controls the vertical movement of the sheet S is provided at the upper part of the conveying lower guide 127.

The lateral register correcting portion 23 has two (a plurality of) conveying rollers 3*g* that conveys the sheet. Here, when the conveying roller 3*g* is one, the edge of the sheet is easily rotated during conveyance. In this case, when the edge of the sheet is conveyed, the skew feeding of the sheet maybe come great or the sheet may be shifted in the width direction. Therefore, two or more conveying rollers 3*g* are disposed in the width direction to prevent the sheet from rotating in such a manner.

In FIG. 17(*b*), a path interval PT4 is an interval in a vertical direction of the reference guide 24, the conveying lower guide 127, and the controlling portion member 127*a* in an entire area in a sheet conveying direction of the lateral register correcting portion 23. When the path interval PT4 is too wide, a path difference in a height direction is caused in the width direction of the sheet until the edge of the sheet is discharged from the lateral register correcting portion 23 and nipped by a roller (not shown) at downstream. When the path difference in the height direction is thus caused, skew feeding of the sheet and shifting in the width direction are easily generated at downstream of the lateral register correcting portion 23. Then, a path interval of the reference guide 24 is about 2 mm.

Here, as shown in FIG. 17(*a*), the sheet S shifted by only a width XT in the width direction and conveyed abuts against the sheet introducing portion 24*b* and is then guided in the direction of an arrow Rv by the sheet inserting portion 24*b*. Thereafter, the edge of the sheet is moved in the width direction to a reference line L used as a standard of the width direction. A gap is provided among the reference guide 24 of the conveying lower guide 127, the bottom surface on the opposite side in the width direction, and the sheet S. The side abutted against the sheet introducing portion 24 and the edge portion of the sheet on the opposite side are deflected by a width of the gap, which allows the sheet S to rotate in the direction of the arrow Rv.

However, when the width XT that is a shifted portion of the sheet S in the width direction is large, the deflection amount of the sheet S becomes larger. Accordingly, the elasticity of the sheet S becomes stronger. In this case, unless the reference guide side of the sheet S is not deflected as shown in FIG. 17(*b*), the sheet S cannot be guided, resulting in paper jams. Even if the edge of the sheet can be guided while the sheet S is deflected, when the path interval PT4 is narrow, it is difficult to deflect the sheet S.

On the other hand, when the reference guide side of the sheet S is thus deflected, force acting on the sheet introducing portion 24*b* of the sheet side edge is strengthened by the elasticity of the sheet S due to the deflection. Thus, rubbing and wearing of the sheet introducing portion 24*b* are easily caused. Further, resistance between the sheet side edge and the sheet introducing portion 24*b* becomes larger as the force acting on the sheet introducing portion 24*b* by the sheet side edge is stronger. Then, the resistance becomes conveying resistance, thereby causing paper jams.

For that reason, the sheet can be easily deflected in the sheet conveying direction between a sheet distance ST from the conveying roller 3*g* at the upstream side to the edge of the sheet and it is necessary to have a structure in which the edge of the sheet is rotatable in the direction of the arrow Rv.

On the other hand, FIG. 18 is a diagram illustrating when the pin 24*h*3 is disposed in the sheet introducing portion 24*b* so as to have a distance XP from the pin 24*h*1 provided in the reference surface 24*a*. Here, as shown in FIG. 18(*a*), when the sheet is shifted to the reference surface 24*a* between the distance XP and conveyed, the sheet introducing portion 24*b* slides along the edge of the sheet. This causes rubbing and wearing.

As shown in FIG. 18(*b*), when the sheet S is shifted by only a width XJ that abuts the reference pin 24*h*3 and conveyed, an angle JK formed by a diameter R of the reference pin 24*h*3 and the sheet side edge becomes acute (e.g. 45° or more), thereby causing paper jams.

FIG. 19 is a structure that a part of the sheet introducing portion 24*b* includes a U-shaped metallic member 170 having a path interval T such as SUS and galvanized steel sheet. The path interval T of the U-shaped metallic member 170 is set to about 2 to 3 mm taking into consideration the height and the conveying performance of the lateral register correcting portion in itself. Since the path interval T of the metallic member 170 is narrow, each corner of the inner wall has a form R of about 0.5 to 1 mm considering the durability of the metallic mold.

Here, as shown in FIG. 19(*a*), when the sheet S is shifted by the width −X and conveyed in the direction of the arrow B, the metallic member 170 guides the edge of the sheet toward the direction of the arrow Rv so as to move along the sheet introducing portion 24*b*.

However, each corner of the inner wall of the metallic member 170 has the form R and thus the sheet end portion is curled up along the form R while the metallic member 170 guides the edge of the sheet to the reference surface 24*a* as shown in FIG. 19(*b*). As a result, the metallic member 170 cannot guide the edge of the sheet toward the direction of the arrow Rv and the curled edge of the sheet is folded. Then, paper jams are caused by the conveying resistance of the sheet S.

Even if the sheet S is guided to the reference surface 24*a* and conveyed in a state that the shifting of the sheet S is slight and the edge of the sheet is not curled up, sliding surface along the sheet side edge of the metallic member 170 is scratched and worn as the duration of use becomes longer. When the metallic member 170 is scratched by the sheet side edge, the sliding resistance along the sheet side edge maybe increased. Finally, paper jams are caused by the scratched metallic member 170 and resistance between the worn surface and the sheet side edge.

When each corner of the metallic member 170 has a rectangular form instead of the form R without taking into consideration the metallic mold strength, curing of the edge of the sheet can be prevented. However, as the duration of use becomes longer, each corner portion of the metallic member 170 is significantly scratched and worn by the sheet side edge to be guided. As a result, paper jams are caused by sliding resistance.

For that reason, it is important to reduce the force acting on the side edge of the sheet introducing portion 24*b* as well as scratching and wearing of the sheet introducing portion 24*b* by the elasticity of the sheet when the edge of the sheet is guide in the direction of the arrow Rv. Here, if the sheet side edge can be easily rotated in the direction of the arrow Rv, the force acting on the side edge of the sheet introducing portion 24*b* by the sheet side edge can be reduced.

JP-A No. 2004-299856 describes a structure that includes a first reference guide surface 12*a* that abuts against the side edge of letter-size and A4-size sheets and a second reference guide surface 12*b* that is a side edge standard of the sheets S of an executive-size and a B5 size. Further, in order to adapt to an A5-size sheet, namely a sheet S1 having a width narrower than that of A5 paper, the third reference guide surface 12*c* is included. The first reference guide surface 12*a*, the second reference guide surface 12*b*, and the third reference guide surface 12*c* are respectively formed so that they are shifted in the width and thickness directions of the sheet to be conveyed.

Here, when the sheet is conveyed while the side edge of the sheet abuts against the first reference guide surface 12*a*, a supporting surface 12*a*1 which supports an end portion of the sheet is positioned higher than a guiding surface 20*a* of a conveying lower guide 20 which guides the other end of the sheet. In the structure of JP-A 2004-299856, the sheet is conveyed in a downstream direction in the condition where the height of the end portion of the sheet is different from that of the other end, and thus there is a difference in height between both ends of the sheet. As a result, the accuracy of the sheet position is reduced.

SUMMARY OF THE INVENTION

The present invention has been achieved in view of the above circumstances and provides a sheet conveying apparatus and an image forming apparatus in which paper jams can be reduced and shifting in a horizontal direction of the sheet can be corrected.

According to the present invention, there is provided a sheet conveying apparatus which includes a reference guide in which a reference surface that is elongated in a sheet conveying direction and abuts against an end portion of a sheet is formed, a sheet introducing portion which is provided at the upstream in the sheet conveying direction of the reference guide and has an inclined surface which abuts against the end portion of the sheet is inclined to the central portion side in a width direction intersecting with the sheet conveying direction from the upstream to the downstream, and guides the sheet which is shifted to the opposite side of the central portion of a conveying passage for the sheet rather than the reference surface of the reference guide and conveyed to the reference surface side, a passage portion which is provided at the central side in the width direction intersecting with the sheet conveying direction rather than the reference guide and the sheet introducing portion, a sheet guide portion which is provided among the reference surface, the inclined surface, and the passage portion in the width direction and guides the sheet, and an upstream side guide forms the passage portion and guides the sheet, wherein the upstream side guide is provided at a position away from the sheet conveyed in a thickness direction of the sheet rather than the sheet guide portion so that the inclined surface side of the sheet is deflected when the end portion of the sheet abuts against an inclined surface of the sheet introducing portion and the sheet conveying apparatus further includes an inclined guide which is provided at the downstream side of the upstream side guide in the passage portion, guides the sheet conveyed by the upstream side guide, and is inclined in the thickness direction of the sheet so as to narrow a path interval of the passage portion.

According to the present invention, shifting in the width direction of the sheet can be corrected without causing paper jams.

Further features of the present invention will become apparent from the following description of exemplary embodiments (with reference to the attached drawings).

BRIEF DESCRIPTION OF THE DRAWINGS

FIGS. 11A and 1lB are cross-sectional views of a reference guide and a conveying lower guide formed on the sheet conveying surface of the lateral register correcting unit.

DESCRIPTION OF THE EMBODIMENTS

Herein after, an exemplary embodiment of the present invention will be specifically described with reference to the drawings.

Figure 1:
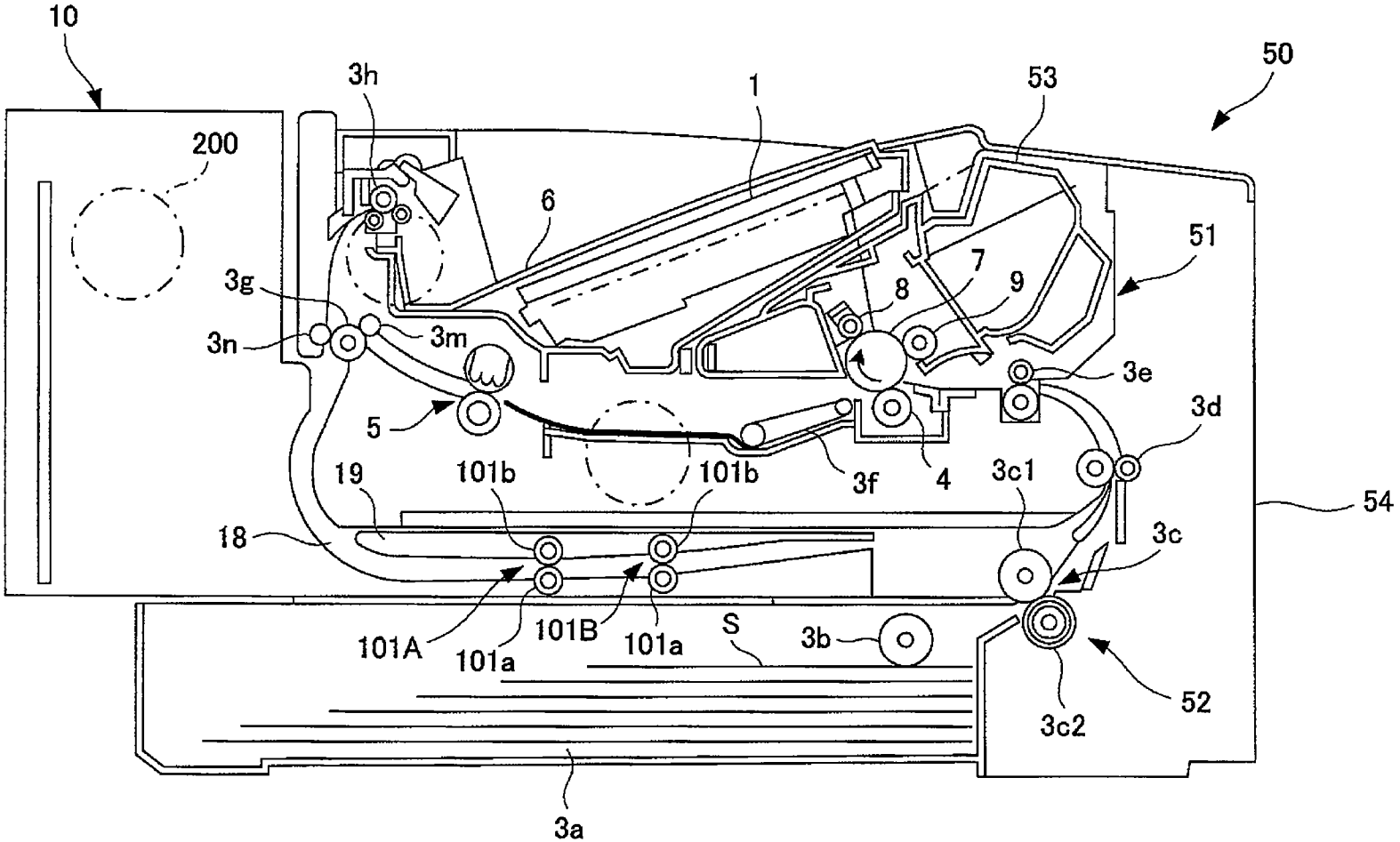
FIG. 1 is a diagram illustrating a schematic structure of a laser beam printer that is one example of an image forming apparatus having a sheet conveying apparatus according to an embodiment of the present invention.

FIG. 1 is a diagram illustrating the schematic structure of a laser beam printer that is one example of an image forming apparatus having a sheet conveying apparatus according to the embodiment of the present invention.

In FIG. 1, the laser beam printer 50 forms an image by an electrophotographic system. The laser beam printer 50 has an image forming portion 51 that performs image formation and a feeding portion 52 that feeds a sheet S to the image forming portion 51 one by one. Further, the laser beam printer 50 is optionally equipped with a duplex unit 10 that is a sheet conveying apparatus for feeding the sheet S to the image forming portion 51 again so that an image is formed on back side after image formation on one side in order to form images on the duplex side of the sheet S.

Here, the image forming portion 51 has a process cartridge 53 and a transfer roller 4. The feeding portion 52 has a sheet cassette 3*a* that stacks the sheet S and a pair of separation rollers 3*c* including a pickup roller 3*b*, a feed roller 3*c*1, and a retard roller 3*c*2. The process cartridge 53 integrally includes a photoconductor drum 7, a charging roller 8 that uniformly charges the surface of the photoconductor drum, and a developing unit 9 that develops an electrostatic latent image formed on the photoconductor drum. They are detachably attachable to a main body of the laser beam printer (hereinafter referred to as the main body of the apparatus) 54.

The duplex unit 10 has a reconveying passage 18 that conveys the sheet in which an image is formed on one surface by the image forming portion 51 to the image forming portion 51 again and a lateral register correcting unit, to be hereinafter described, which has a pair of skew conveying rollers 101A that is a skew conveying unit. A laser scanner unit 1, a fixing portion 5, a discharge tray 6, and a conveying upper guide 19 that forms the upper surface of the reconveying passage 18 are shown in FIG. 1.

Subsequently, image forming operation of the laser beam printer 50 having such a structure will be described.

Image data is transmitted to from a personal computer (not shown) to a controlling portion (not shown) and the image data is subjected to image formation processing at the controlling portion. Thereafter, when a print signal is generated from the controlling portion, the photoconductor drum 7 first rotates in the direction of an arrow and is uniformly charged at a predetermined polarity and potential by the charging roller 8. Then, the photoconductor drum 7 whose surface is thus charged is irradiated with a laser beam emitted from a laser scanner 1 based on the image data, thereby forming an electrostatic latent image on the photoconductor drum 7. Next, the electrostatic latent image is developed by the developing unit 9 so as to be visualized as a toner image.

On the other hand, concurrently with such a toner image forming process, the sheet S which is stacked and housed in the sheet cassette 3*a* is conveyed by the pickup roller 3*b* and then separately conveyed by the pair of separation rollers 3*c*. Thereafter, the sheet S is conveyed to a transfer portion including the photoconductor drum 7 and transfer roller 4 by the pair of conveying rollers 3*d* and 3*e*.

At this time, the edge of the sheet S is detected by a resist sensor (not shown) that is provided at upstream of the transfer portion. In response to a signal detected by the resist sensor, the controlling portion synchronizes the edge position of the sheet S and a light-emitting timing of the laser scanner 1. This allows for transferring the toner image formed on the photoconductor drum to a predetermined position on the sheet S.

Subsequently, the sheet S to which the toner image is thus transferred is conveyed to the fixing portion 5 along a conveying belt 3*f*. The sheet S is heat pressed when passing through the fixing portion 5. As a result, the toner image is semi-permanently fixed.

Here, when one side is printed, the sheet S passed through the fixing portion 5 is conveyed to a nip between the conveying roller 3*g* that is forward reverse rotatable and a first roller bearing 3*m* and then discharged to the discharge tray 6 by the forward rotation of the conveying roller 3*g* and the forward rotation of a discharge roller 3*h* that is forward reverse rotatable.

On the other hand, when the duplex side is printed, the discharge roller 3*h* conveys the sheet S to the discharge tray 6 by the forward rotation and then the rear end of the sheet is reversed after passing through the conveying roller 3*g*. Here, when the rear end of the sheet S is passed through the conveying roller 3*g*, the rear end is directed to the side of a second roller bearing 3*n* by the elasticity. Further, when the discharge roller 3*h* is reversed in such a state, the rear end of the sheet S enters into a nip between the conveying roller 3*g* and the second roller bearing 3*n* and the rear end is nipped by the conveying roller 3*g* and the second roller bearing 3*n*.

When the sheet S is nipped by the second roller bearing 3*n* in such a manner, the conveying roller 3*g* is reversed. Thus, the sheet S passes through the reconveying passage 18 of the duplex unit 10, skew feeding is corrected by a pair of skew conveying rollers 101A. Thereafter, the sheet S is conveyed to the image forming portion 51 through the intermediate roller 3*d* and an image is formed on the second surface in the image forming portion 51. Then, the sheet S is stacked on the discharge tray 6 by the discharge roller 3*h*.

Figure 2:
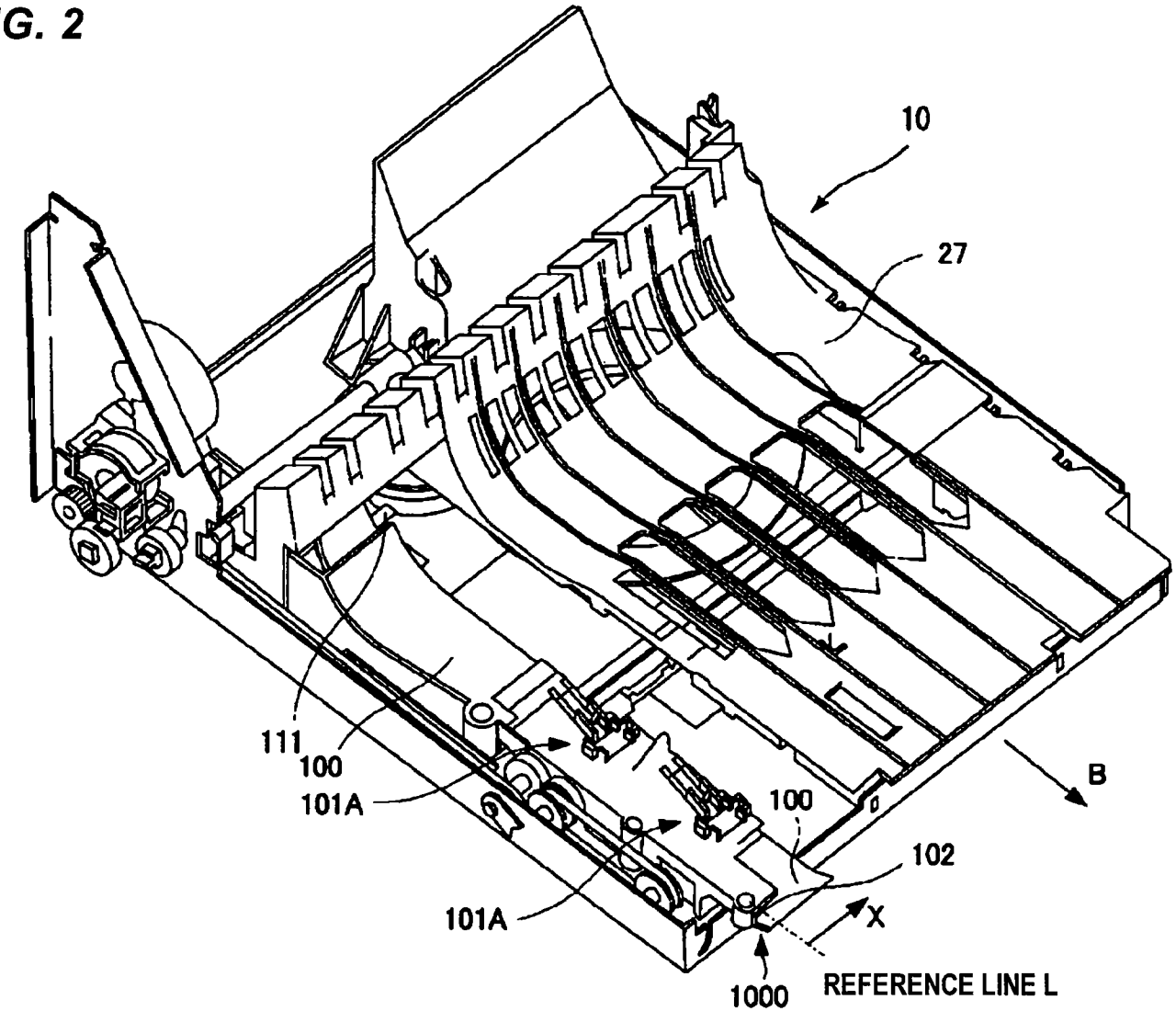
FIG. 2 is a perspective view illustrating the upper portion of a duplex unit that is the sheet conveying apparatus.

As shown in FIG. 2, the duplex unit 10, i.e. the sheet conveying apparatus, includes a lateral register correcting unit 1000 that is a skew feeding correction unit having the pair of skew conveying rollers 101A and the reference guide 100 that holds them. In FIG. 2, a conveying lower guide 27 is arranged in parallel to the reference guide 100 and formed on the undersurface (passage portion) of the reconveying passage 18. Then, the sheet passing the reconveying passage 18 is reconveyed to the image forming portion through between the conveying lower guide 27 and the conveying upper guides 19 (refer to FIG. 1), and the reference guide 100. In this regard, the conveying lower guide 27 is provided on the central side in the width direction of a sheet feeding portion (hereinafter described) of the reconveying passage 18.

Here, a reference surface 102 that is used to perform lateral register correction in the width direction of the sheet pushed by the pair of skew conveying rollers 101A when passing through the reconveying passage 18 is provided at one end portion in the width direction (thrust direction) of the reference guide 100.

Figure 3:
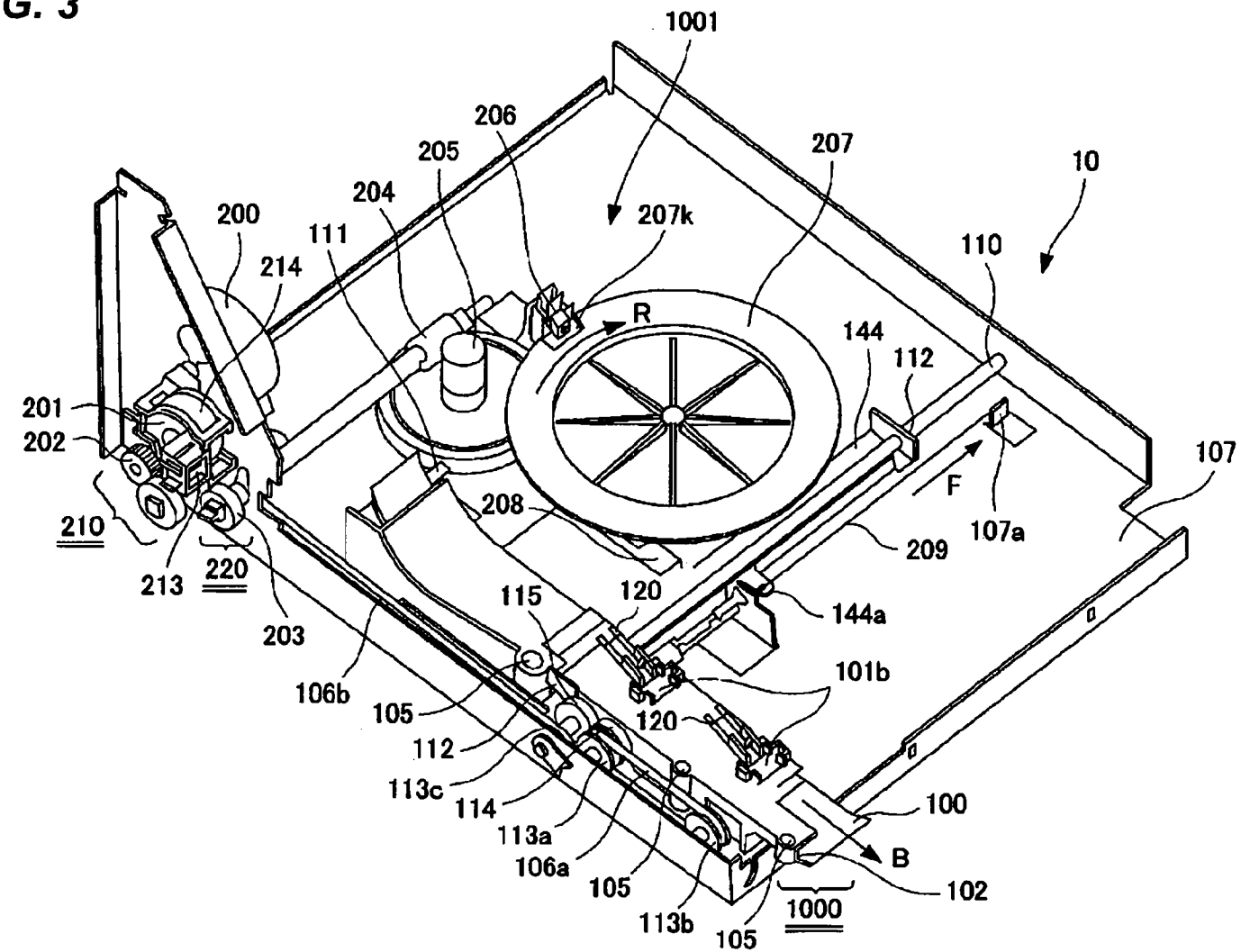
FIG. 3 is a perspective view describing the structure of the duplex unit.

The reference surface 102 which is elongated in the sheet conveying direction and includes a guide in the width direction of the sheet is rubbed by the sheet to be pressed. Thus, as shown in FIG. 3, the reference surface 102 is enhanced by pressing a reference pin 105 including metal (e.g. a plurality of SUSs) thereinto. The reference guide 100 has a U-shaped form, is formed by using resins such as PC+ABS, PPE, and ABS, and includes a convey guide surface for the width direction and the upper and lower surface of the sheet.

The pair of skew conveying rollers 101A include a skew conveying roller 101*a* and a driven roller bearing 101*b* that is obliquely pressure-welded to the skew conveying roller 101*a* at a predetermined skew conveying angle as shown in FIG. 1. As shown in FIG. 3, the driven roller bearing 101*b* is always pressure-welded to the skew conveying roller 101*a* by a torsion spring 120 at a predetermined pressure.

The pair of skew conveying rollers 101A that has the above-described structure and is held by the reference guide 100 draws the sheet conveyed by the conveying roller 3*g* (see FIG. 1) which is provided at upstream of the lateral register correcting unit 1000 to the reference surface 102. Thereafter, the pair of skew conveying rollers 101A conveys the sheet while allowing the sheet to move along the reference surface 102. Thus, the position in the width direction of the sheet S is moved to a reference line connected with the reference pin 105. In the state, the sheet S is conveyed to the intermediate roller 3*d* provided at downstream of the lateral register correcting unit 1000.

FIG. 3 illustrates a stepping motor 200 and timing belts 106*a* and 106*b* and a driving force of the stepping motor 200 is transmitted to the pair of skew conveying rollers 101A via the timing belts 106*a* and 106*b* and pulleys 113*a* to 113*c*. In the present embodiment, the stepping motor 200 is forward reverse rotatable so as to allow a cam 207 (hereinafter described) to rotate.

In the lateral register correction process in which the sheet S is skew conveyed and the position in the width direction is matched while the sheet S is pressed against the reference surface 102 of the reference guide 100, the distance for drawing the sheet S to the reference surface 102 is up to about several mm in a direction +X from the reference line L shown in FIG. 2.

However, sometimes the sheet is drawn to the reference surface 102 at a position 2 mm or more away in the direction X from the reference line L depending on the sheet size. In this case, it is necessary to increase the amount of skew conveying. For the purpose, a nip pressure of the pair of skew conveying rollers 101A needs to be set to a high level.

Figure 4:
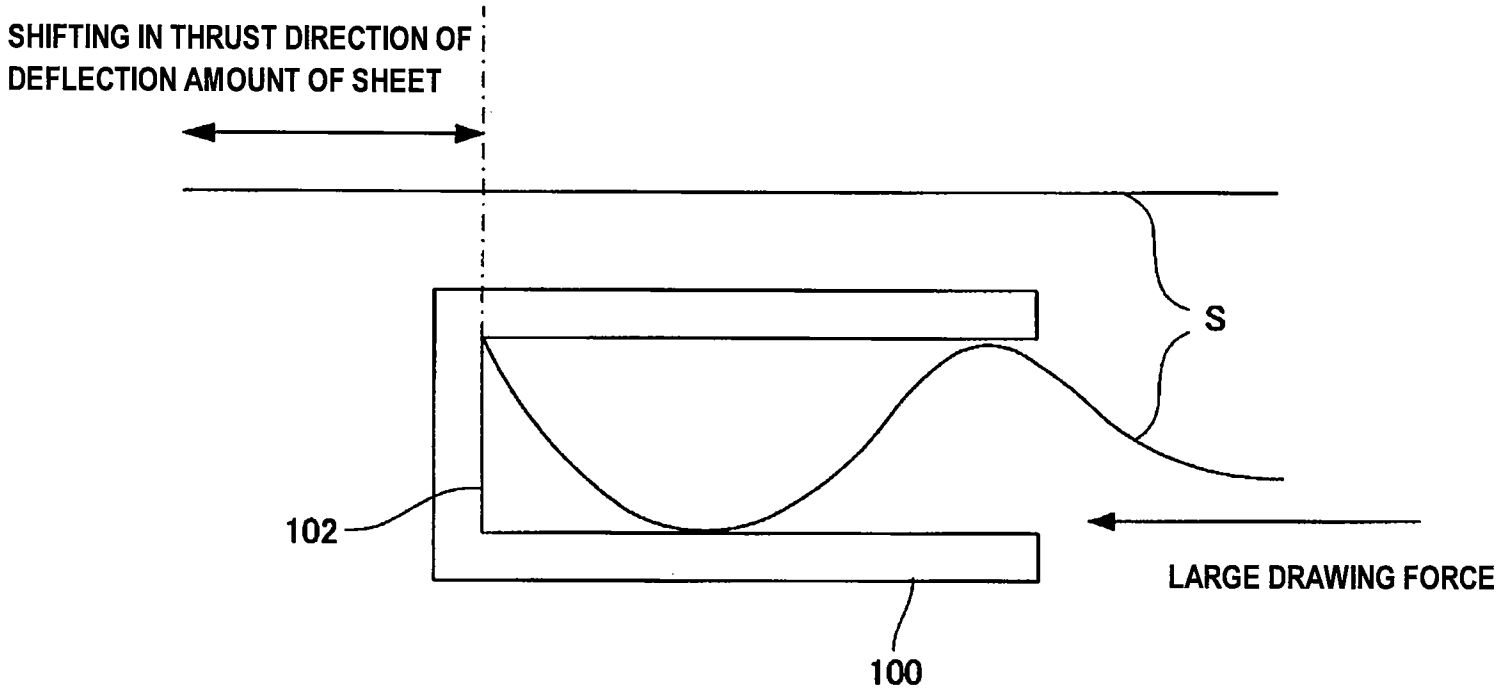
FIG. 4 is a diagram illustrating a state when a sheet is drawn to a reference surface by a large drawing force of a lateral register correcting unit of the duplex unit.

However, when the nip pressure is set to the high level, the sheet S is deflected since a drawing force on the reference surface 102 is too strong in the case of the thin sheet as shown in FIG. 4. Then, the position in the width direction of the sheet to the reference surface 102 is shifted and the sheet is reconveyed. Further, when the drawing force in the width direction is too strong, the reference surface 102 between the reference pins 105 is scratched by the sheet end portion as it is used for a long period of time, and thus paper jams are caused by the scratches.

In the present embodiment, the reference guide 100 (whose reference surface 102) can be moved to a position depending on the length in the width direction of the sheet so that lateral register correction of sheets of various sizes can be achieved. Specifically, the lateral register correcting unit 1000 is moved in the width direction depending on the sheet size (the length in the width direction of the sheet) so that a moving distance for drawing the sheet S to the reference surface 102 is about 2 mm.

Subsequently, a movable portion 1001 that moves the lateral register correcting unit 1000 in the width direction in such a manner will be described with reference to FIGS. 3 and 5.

Figure 5:
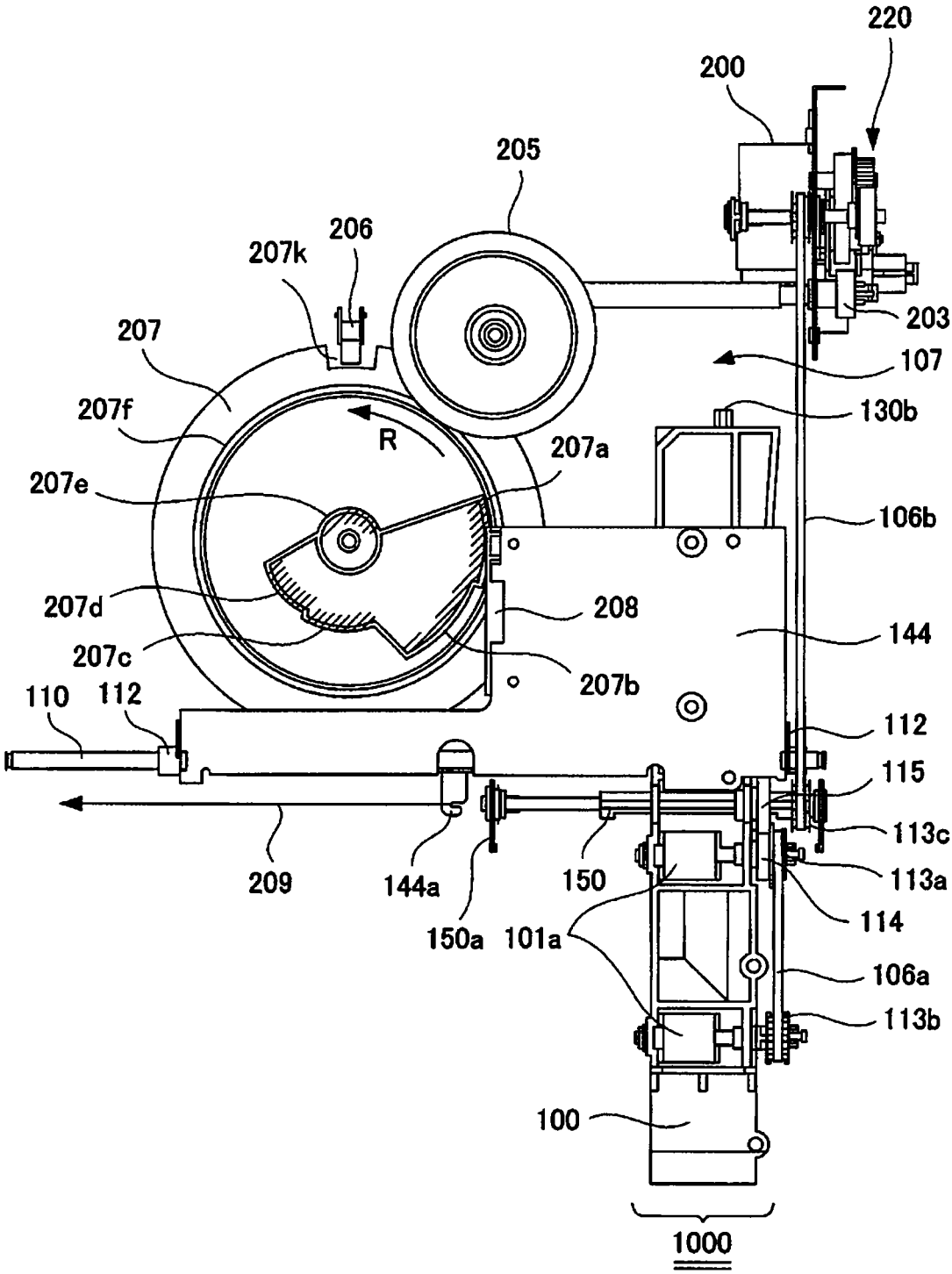
FIG. 5 is a schematic bottom perspective view describing the structure of a movable portion which moves the lateral register correcting unit.

In FIGS. 3 and 5, a bottom plate 107 is a structure of the duplex unit 10 and a principal axis 110 including SUS and SUM is provided in the width direction of the bottom plate 107. Further, a plate 144 having bearings 112 that axially support the principal axis 110 is mounted on the bottom surface of the lateral register correcting unit 1000 so that the lateral register correcting unit 1000 can move in an axial direction along the principal axis 110.

The lateral register correcting unit 1000 is mounted on the bottom plate 107 via the bearings 112 and the principal axis 110 which are provided at the plate 144 so as to be movable in the width direction. The bearings 112 set the position of the lateral register correcting unit 1000 relative to the bottom plate 107 via the principal axis 110. The bearings 112 are disposed at two places and a span extending in the width direction is placed between the bearings 112. As a result, the accuracy of position which determines the printing accuracy of the lateral register correcting unit 1000 based on the part accuracy and variations can be reduced.

Figure 6:
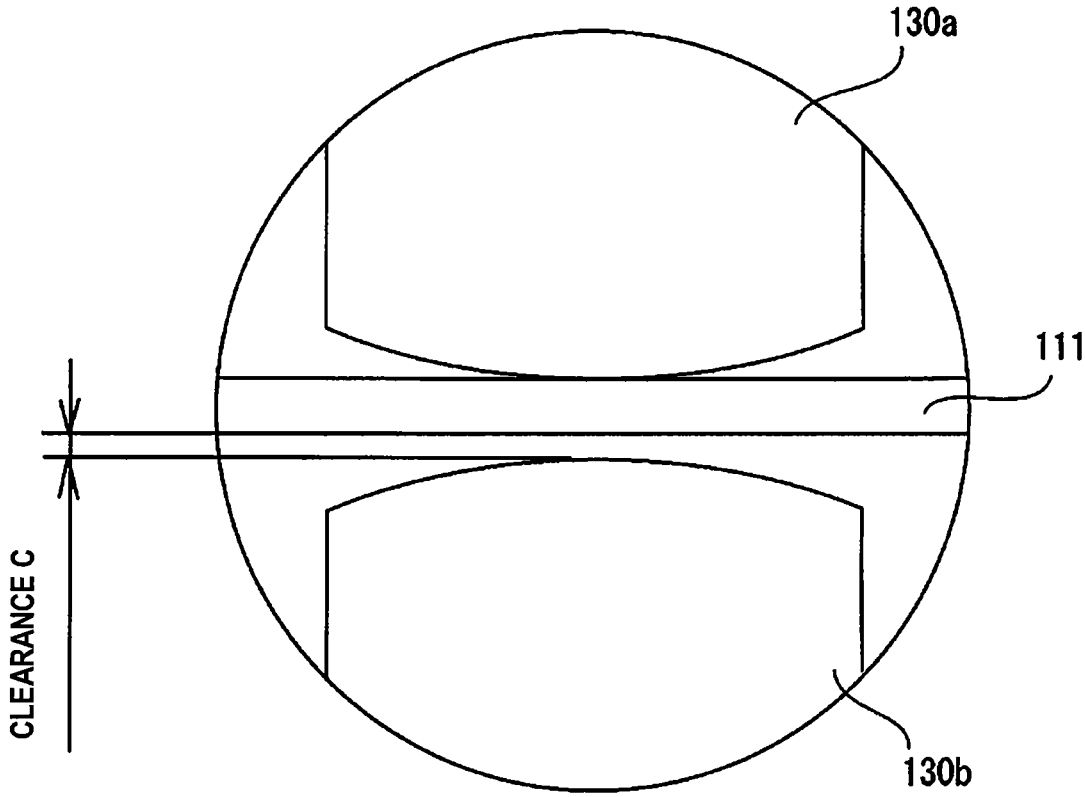
FIG. 6 is an enlarged view of a rail portion provided to move the lateral register correcting unit.

As shown in FIG. 2, a rail portion 111 which is bent into a form Z from the bottom plate 107 is provided in parallel with the principal axis 110 at the upstream side in the sheet conveying direction of the bottom plate 107. Further, as shown in FIG. 6, rotation stopping members 130*a* and 130*b* which engage with the rail portion 111 and controls rotation around the principal axis 110, i.e, a fulcrum point, of the reference guide 100 (the lateral register correcting unit 1000) are provided in the reference guide 100.

The abutting surface of the rotation stopping members 130*a* and 130*b* against the rail portion 111 has a circular arc shape and about 0.2 mm of a clearance C is provided between the rail portion 111 and the rotation stopping member 130*a* and 130*b*. Even if the shift of parallelism between the principal axis 110 and the rail portion 111, the warpage of the plate 144, and other common differences are occurred, the rotation stopping members 130*a* and 130*b* are engaged with the rail portion 111 by a point contact when the clearance C is provided.

This allows the sliding resistance when the lateral register correcting unit 1000 moves in the width direction to be reduced. As a result, the lateral register correcting unit 1000 smoothly moves in the width direction and the accuracy of position for the bottom plate 107 can be ensured.

In FIGS. 3 and 5, a cam 207 is provided at the side of the reference guide 100 and rotates only in an R-direction (one way). The cam 207 has a gear 207*f* that meshes with a double gear 205 and cam surfaces 207*a* to 207*e*. As described below, five pieces of the cam surfaces 207*a* to 207*e* are used when the lateral register correcting unit 1000 is moved to a position where lateral register correction of each of the letter-size, A4-size, EXE-size, B5-size, and A5-size sheets can be performed and held thereto.

The cam 207 is driven by the stepping motor 200 via a driving gear line 220 of the lateral register correcting unit, a worm gear 204, and the double gear 205.

An initial sensor 206 of the cam 207 detects an initial rotating position of the cam 207 by the detection of a notch portion 207*k* formed in a peripheral portion of the cam 207. In the present embodiment, when the cam 207 is located at the initial position, the reference line L of the lateral register correcting unit 1000 (refer to FIG. 2) is the position where lateral register correction of the letter-size sheet can be performed.

A tension coil spring 209 is a biasing member. An end of the tension coil spring 209 is engaged with a hanging portion 144*a* which is provided on the plate 144 as described above and the other end is locked with a locking portion 107*a* which is vertically-placed on the bottom plate 107. The plate 144 is energized in the direction of an arrow F which is the width direction by the tension coil spring 209.

A pressure welding portion 208 which is pressure-welded to the cam surfaces 207*a* to 207*e* of the cam 207 by the tension coil spring 209 is provided on the plate 144. The lateral register correcting unit 1000 is pressure-welded to the cam surfaces 207*a* to 207*e* of the cam 207 via the pressure welding portion 208 by the tension coil spring 209.

Thus, the movable portion 1001 includes the cam 207, the pressure welding portion 208, and the stepping motor 200 which rotates the tension coil spring 209 and the cam 207 while resisting an energizing force of the tension coil spring 209. When such a structure of the movable portion 1001 is provided, the plate 144 which is pressure-welded to the cam 207, namely the lateral register correcting unit 1000 can be moved from a letter position shown in FIG. 5 to an A5 position shown in FIG. 7 by rotation of the cam 207.

In the lateral register correcting unit 1000, a point of force of the hanging portion 144*a* of the tension coil spring 209 and a cam pressing portion of the pressure welding portion 208 is arranged in a span between the bearings 112 in the width direction. This inhibits prying of the lateral register correcting unit 1000 from the principal axis 110 by a moment of energizing force. Thus, the lateral register correcting unit 1000 can be smoothly moved in the width direction.

Subsequently, operation for moving the lateral register correcting unit 1000 to the lateral register correcting position in accordance with the size of the sheet will be described.

For example, when the lateral register correcting unit 1000 is located at the letter position (initial position), the pressure welding portion 208 is pushed to the cam surface 207*a* corresponding to the letter position of the cam 207 by an energizing force of the tension coil spring 209 as shown in FIG. 5. As a result, the position of the lateral register correcting unit 1000 is fixed to the lateral register corrected position depending on a letter-size sheet.

Figure 7:
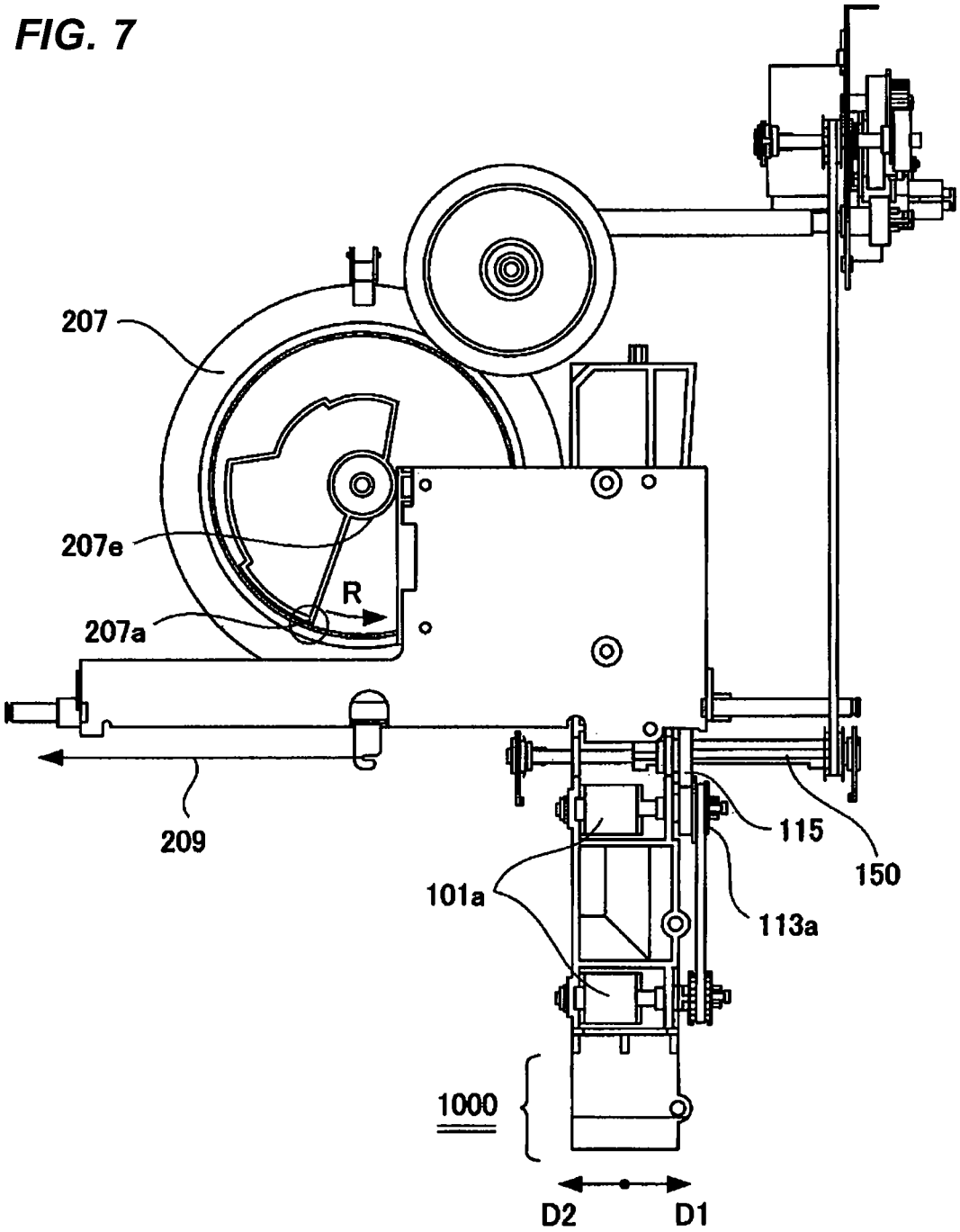
FIG. 7 is a bottom perspective view illustrating a state when the lateral register correcting unit is moved.

For example, in order to move the lateral register correcting unit 1000 to the position A5 shown in FIG. 7 in the state, the stepping motor 200 is rotated at a predetermined step number.

Here, in the present embodiment, the pair of skew conveying rollers 101A (skew conveying roller 101*a*) is driven by one piece of the stepping motor 200 as described above and the lateral register correcting unit 1000 is moved by the movable portion 1001.

In FIG. 5, a driving gear line 220 transmits the driving force of the stepping motor 200 to the cam 207. When the stepping motor 200 rotates, the cam 207 rotates in the direction of the arrow R via the driving gear line 220. Accordingly, the cam surface that abuts against the pressure welding portion 208 is changed in the following order: the cam surface 207*a*, a cam surface 207*b*, a cam surface 207*c*, a cam surface 207*d*, and a cam surface 207*e*. As a result, the lateral register correcting unit 1000 moves in the direction of an arrow D2 shown in FIG. 7 and moves to the lateral register corrected position corresponding to the A5-size sheet through the letter-size, A4-size, EXE-size, and B5-size positions.

When the lateral register correcting unit 1000 is returned to the letter position shown in FIG. 5, the cam 207 is rotated in the direction of the arrow R by rotating the stepping motor 200. As a result, the cam surface 207*a* presses the pressure welding portion 208 while resisting the spring 209. Accordingly, the lateral register correcting unit 1000 moves in the direction of an arrow D1 and then moves to the lateral register corrected position corresponding to the letter-size sheet again.

Figure 8:
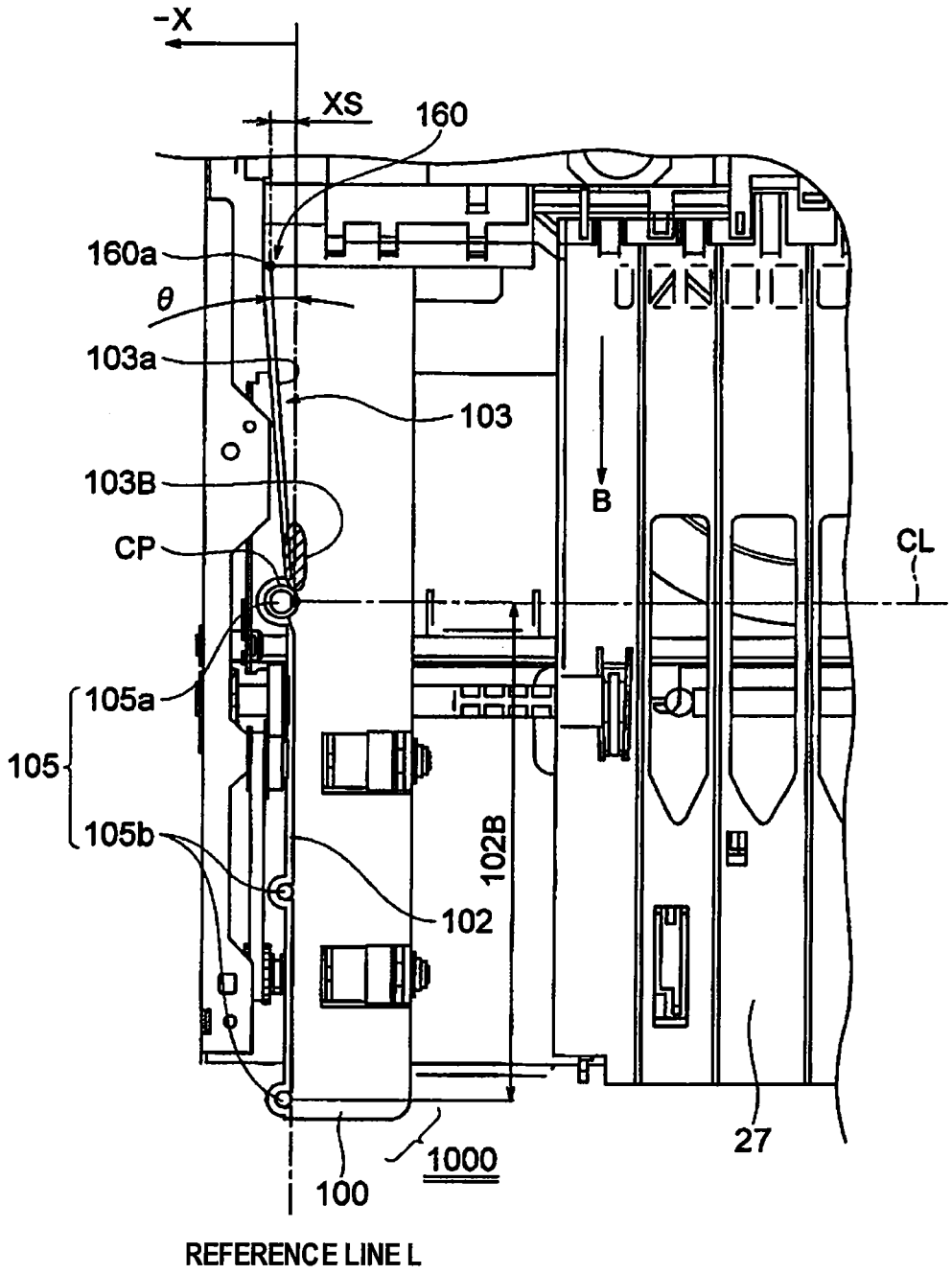
FIG. 8 is a top perspective view of the lateral register correcting unit.

FIG. 8 is a top perspective view illustrating a state when a U-shaped upper surface of the reference guide 100 of the lateral register correcting unit 1000 in the present embodiment is cut and the conveying upper guide 19 (refer to FIG. 1) is detached.

As shown in FIG. 8, the reference pins 105*a* and 105*b* are pressed into the reference guide 100, thereby preventing the reference surface 102 from being worn and scratched by sliding of the sheet side edge. Further, the sheet introducing portion 103 having a guiding surface 103*a* that guides the sheet which is shifted in the direction of an arrow −X to the reference surface 102 of the reference guide 100, namely, the opposite side of the central portion of the reconveying passage 18 and conveyed to the reference surface side is provided at the upstream side of the reference guide 100. In the present embodiment, the reference guide 100 and the sheet introducing portion 103 are separately molded and they may be integrally molded.

The sheet introducing portion 103 (reference guide 100) includes a frontage 160 having a distance XS in the width direction from the reference line L so that the edge of the sheet does not hit the frontage in the width direction of the sheet introducing portion 103 when the sheet is shifted in the direction of the arrow −X and conveyed.

Here, the distance XS is about 3 to 7 mm taking into consideration variations in parts when a lot of sheets are fed and variations in the sheet conveying. As a result, a sufficient margin of the frontage 160 based on shifting in the width direction of the sheet is ensured. Further, an angle θ of the guiding surface 103*a* is an angle that extends in the direction of an arrow −X from the sheet sliding surface of the reference pin 105*a* to an end portion 160*a* of the frontage 160. That is, the guiding surface 103*a* is inclined to the central portion side in the width direction of the reconveying passage 18 from the upstream to the downstream.

The sheet is shifted in the direction of the arrow −X and conveyed (in drawings) may sometimes reach the sheet introducing portion 103 of the reference guide 100 without hitting the edge of the sheet against the end portion 160*a* of the frontage 160. In this case, it is necessary to guide the side edge of the sheet that is shifted in the direction of the arrow −X to the reference surface 102 corresponding to the reference line L (or a line connected with the sliding surface of the sheet side edge of the pin 105).

At this time, when the angle θ of the sheet introducing portion 103 is large, resistance between the sheet side edge and the sheet introducing portion 103 becomes larger while the sheet is guided to the reference surface 102. Therefore, in some cases, the resistance becomes conveying resistance, thereby causing paper jams. Further, when the elasticity of the sheet is weak, the edge of the sheet is folded, there by causing paper jams.

On the other hand, when the angle θ of the sheet introducing portion 103 is small, such a problem is solved. However, the distance XS in the width direction from the reference surface 102 to the frontage 160 is decreased. In this case, when the sheet is shifted in the direction of the arrow −X and conveyed to the duplex unit 10, the edge of the sheet hits against the frontage 160, thereby causing paper jams. For that reason, in the present embodiment, the angle θ of the guiding surface 103*a* of the sheet introducing portion 103 is set to about 2 to 15° so that the sheet can be reliably received and guided to the reference surface 102.

Figure 19A:
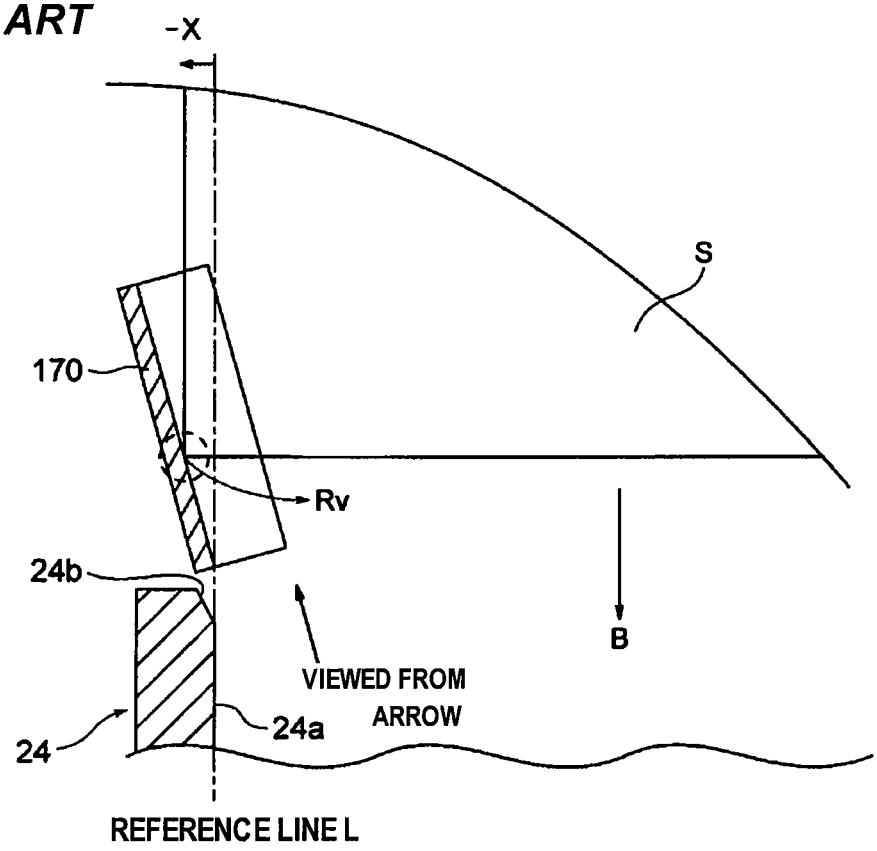
FIG. 19A PRIOR ART
FIG. 19 is a diagram describing a state when the sheet passes through another lateral register correcting portion of the conventional sheet conveying apparatus.
Figure 19B:
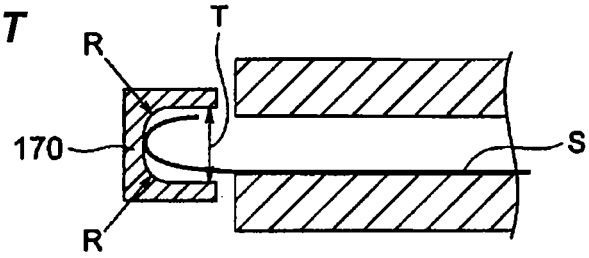
FIG. 19B PRIOR ART

In the present embodiment, a straight line angle in a sheet conveying direction B is provided at the sheet introducing portion 103. The sheet introducing portion 103 may have an R-form in order to guide the edge of the sheet from the frontage 160 to the reference surface 102. Further, the sheet introducing portion 103 may have a spline-shaped form or may be a side edge of the introducing portion of a plurality of straight lines with a plurality of angles. For example, the reference pin 105 which is disposed on the border between the sheet introducing portion 103 and the reference guide 100 may be a U-shaped metal plate including SUS as shown in FIG. 19 described above.

In FIG. 8, a point CP is a point where a line obtained by extending the angle θ of the sheet introducing portion 103 in a straight line toward the sheet conveying direction and the reference line L which includes the reference surface 102 or the reference pin 105 intersect at right angles. The point CP corresponds to the sliding portion of the sheet side edge of the reference pin 105*a*. A CL line is extended in the width direction from a point CP.

On the other hand, in order to reduce scratching and wearing of the reference surface 102 caused by sliding of the sheet side edge, the sheet side edge sliding surface of the reference pin 105 is arranged so as to be projected from the same line as the reference surface 102 or the reference surface 102 by about 0.1 to 0.3 mm in the width direction. When the reference pin 105 is provided, scratching and wearing caused by the sheet side edge can be reduced by the reference pins 105*a* and 105*b* in a region 102B between the reference pins 105*a* and 105*b* in the sheet conveying direction of the reference surface 102. In this regard, the reference line L which is a reference line in the width direction includes a line connected with the reference surface 102 or the sliding surface of the sheet side edge of the reference pins 105*a* and 105*b*.

Figure 9:
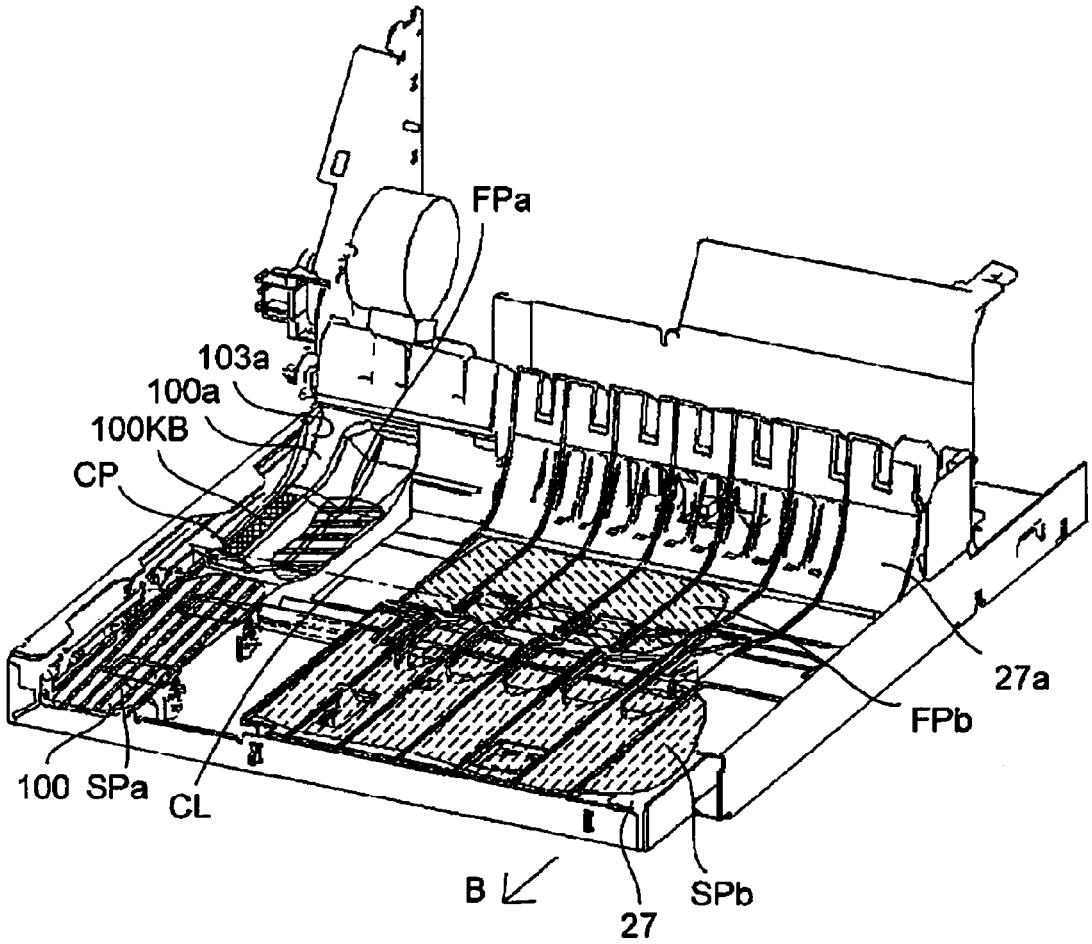
FIG. 9 is a perspective view describing the structure of a sheet conveying surface of the lateral register correcting unit.
Figure 10:
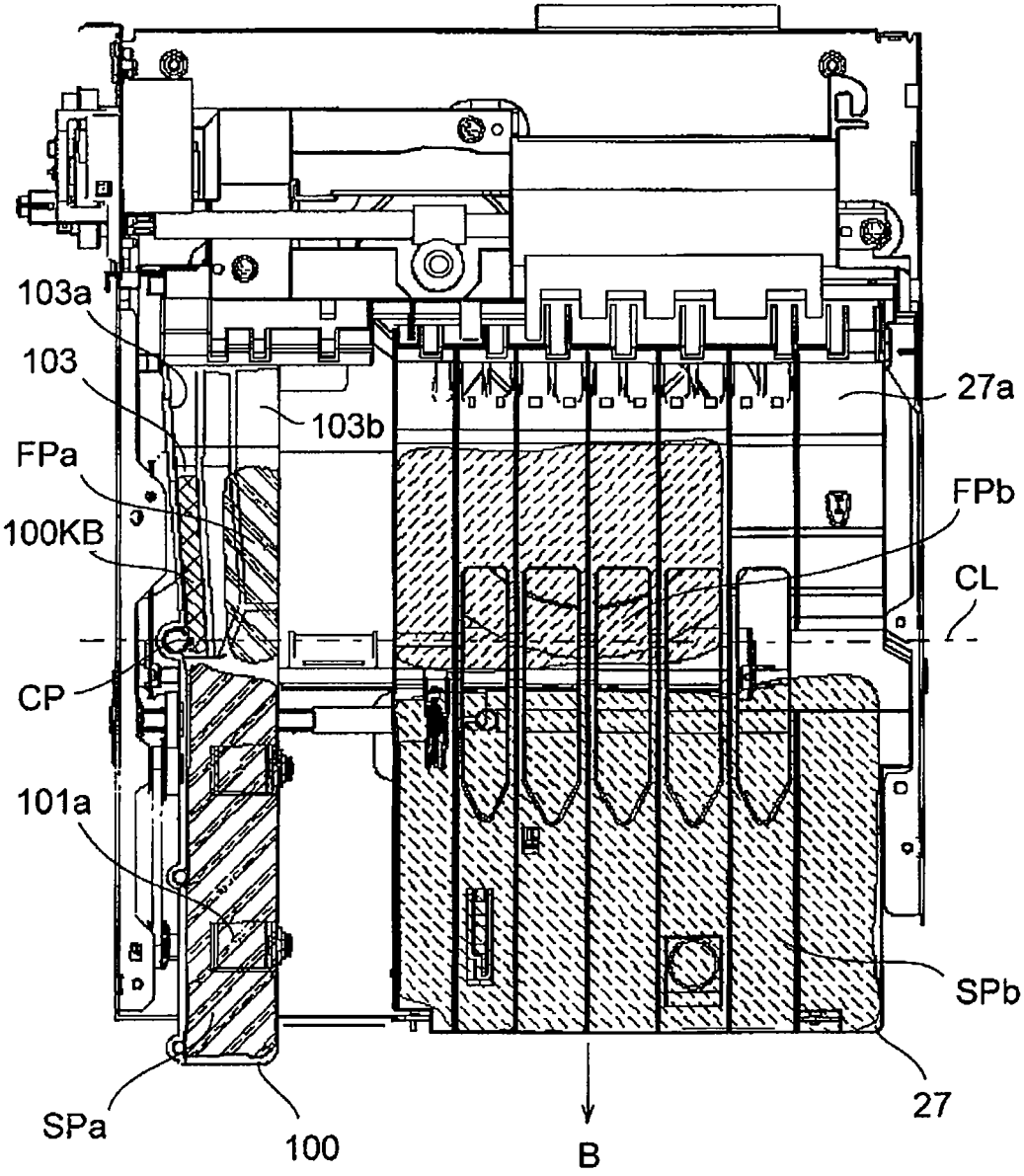
FIG. 10 is a top perspective view describing the structure of the sheet conveying surface of the lateral register correcting unit.

FIG. 9 is a perspective view describing the structure of the sheet conveying surface of the lateral register correcting unit 1000 in the present embodiment. FIG. 10 is a top perspective view thereof.

In FIGS. 9 and 10, a first conveying path portion FPa is provided at the conveying lower guide side of the sheet introducing portion 103 and is a sheet conveying region side portion which includes the conveying lower guide 27 and the sheet conveying region. A second conveying path portion SPa is a sheet conveying surface of the reference guide 100. Further, a sheet introducing portion near-side edge portion 100KB (sheet guide portion) is located at the guiding surface side of the sheet introducing portion 103 and includes a region which abuts against the sheet.

Figure 11A:
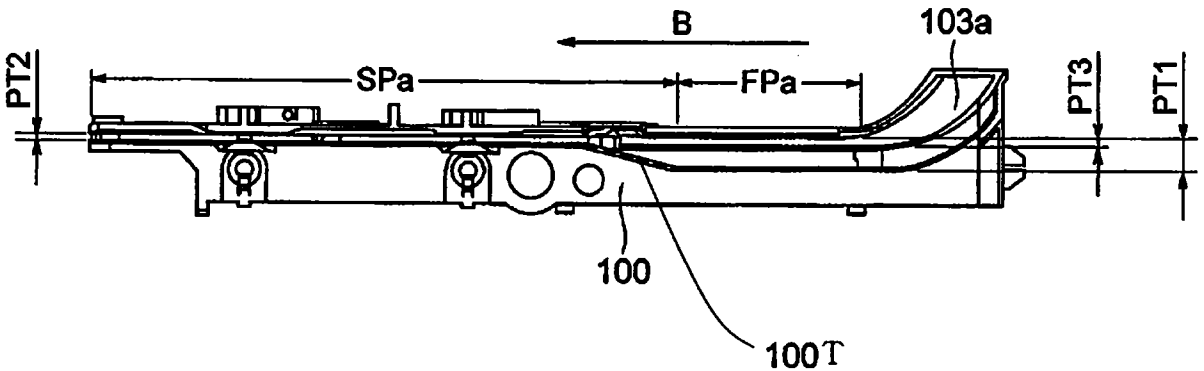

Here, as for a path interval that is an interval in a vertical direction of the first conveying path portion FPa and the second conveying path portion SPa, the path interval PT1 of the first conveying path portion FPa is sufficiently wider than the path interval PT2 of the second conveying path portion SPa as shown in FIG. 11A. That is, in the present embodiment, the sheet conveying surface of the first conveying path portion FPa is located below the sheet conveying surface of the second conveying path portion SPa in the height direction.

Further, the path interval PT3 in the sheet introducing portion near-side edge portion 100KB of the sheet conveying surface of the reference guide 100 is nearly equal to the path interval PT2 of the second conveying path portion SPa as shown in FIG. 11A.

An inclined portion 100T is inclined in the thickness direction of the sheet and guides the sheet which is conveyed from the first conveying path portion FPa at the upstream side to the second conveying path portion FPb at the downstream side.

In FIGS. 9 and 10, a first conveying path portion FPb is provided at the side closer to the upstream in the sheet conveying direction than the vicinity of the line CL of the conveying lower guide 27, namely the reconveying passage side of the sheet introducing portion 103. A second conveying path portion SPb is located at the side closer to the downstream in the sheet conveying direction than the line CL of the conveying lower guide 27, namely the side in the width direction of the reference guide 100 and includes other sheet conveying regions.

Figure 11B:
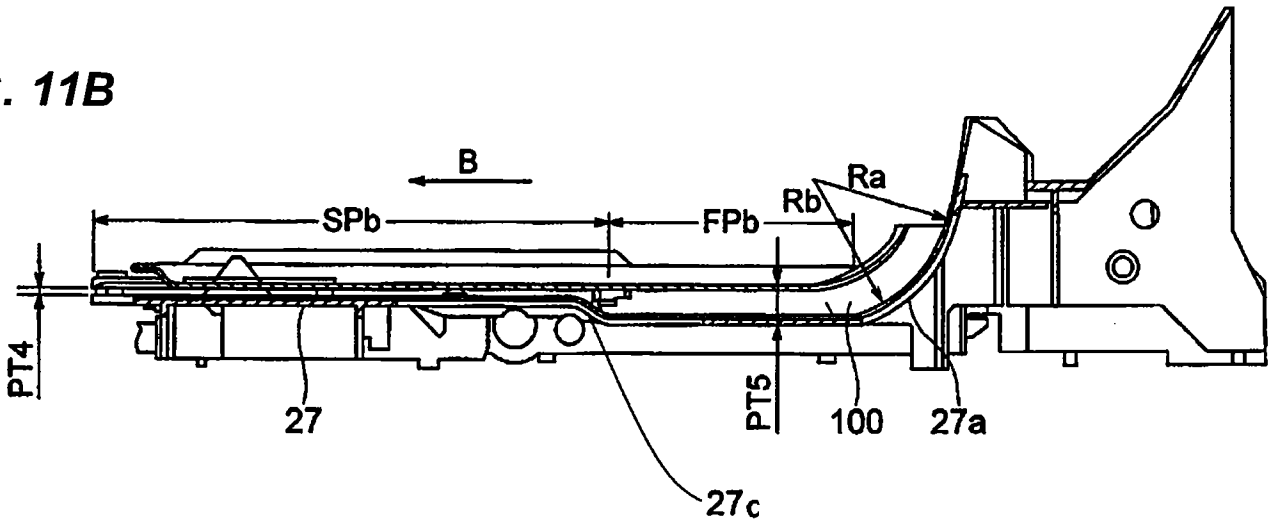

As shown in FIG. 11B, a path interval PT5 of the first conveying path portion FPb has a sufficient interval compared to the path interval PT4 of the second conveying path portion SPb. That is, in the present embodiment, the sheet conveying surface of the first conveying path portion FPb is located below the sheet conveying surface of the second conveying path portion SPb in the height direction.

That is, the conveying lower guide 27 has a curved portion 27*a* along the conveying direction, the first conveying path portion FPb which is the upstream side portion closer to the upstream than the line CL, an inclined portion 27*c*, and a second conveying path portion Spb which is a downstream side portion. The inclined portion 27*c* in the conveying lower guide 27 is an inclined guide which is inclined in the thickness direction of the sheet. The inclined portion 27*c* guides the sheet which is conveyed from the first conveying path portion FPa at the upstream side to the second conveying path portion FPb at the downstream side.

Here, as shown in FIG. 11B, a curved portion 103*b* of a curvature Rb is formed at the upstream side of the sheet introducing portion 103 and the curved portion 27*a* of a curvature Ra is formed at the upstream side of the conveying lower guide 27. The sheet is conveyed in the lateral register correcting unit along the curved portion 27*a* of the conveying lower guide 27 and the curved portion 103*b* of the sheet introducing portion 103.

In the second conveying path portion SPa, the path interval PT2 is equal to the path interval PT4. That is, the second conveying path portion SPa which is a sheet conveying surface of the reference guide 100 is set to the same height as that of the second conveying path portion SPb in the conveying lower guide 27.

According to the present embodiment, each radius of the curved portion 27*a* of the conveying lower guide 27 and the curved portion 103*b* of the sheet conveying portion 103 is about R20 to R50. The path intervals of PT2, PT3, and PT4 are about several mm and the path intervals PT1 and PT5 have intervals sufficiently wider than those.

Figure 12:
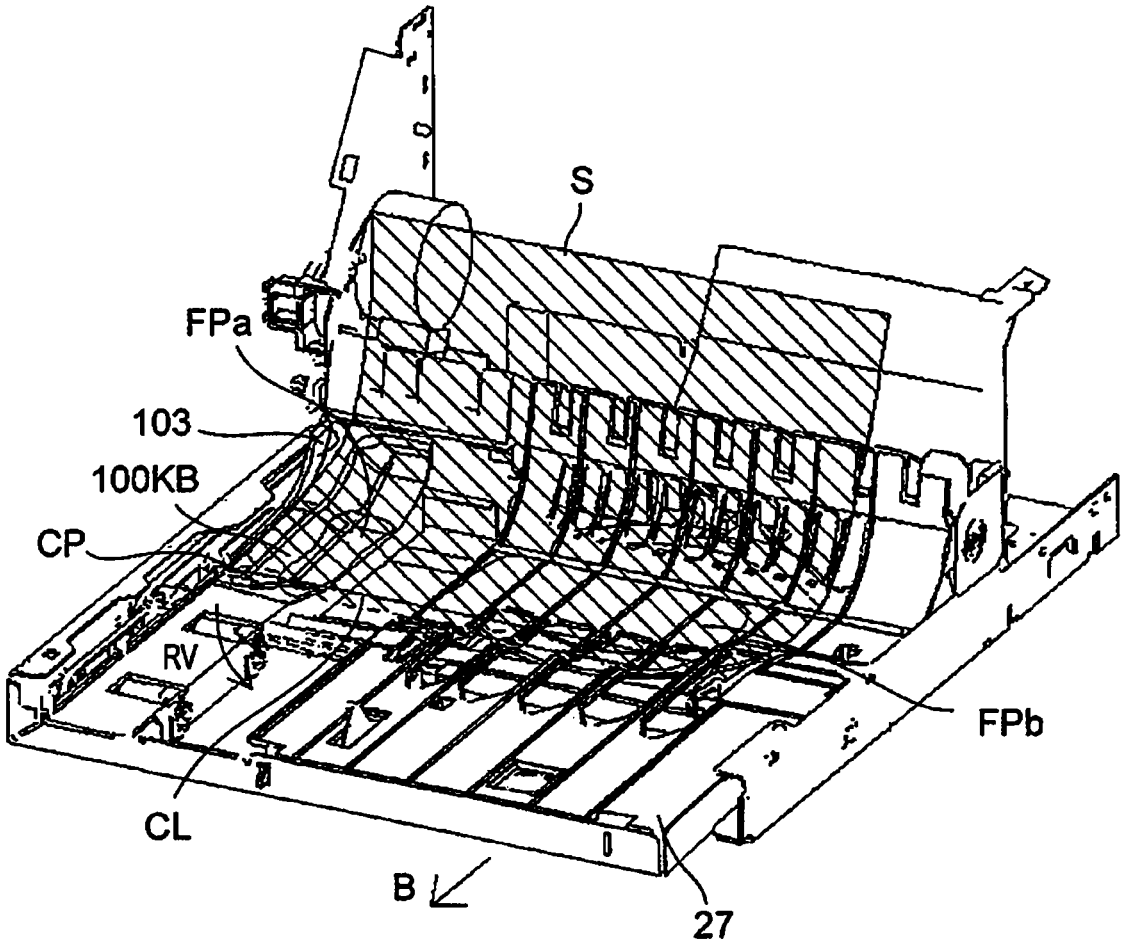
FIG. 12 is a perspective view describing lateral register correcting operation of the sheet in the lateral register correcting unit.

Subsequently, lateral register correcting operation of the sheet in the lateral register correcting unit 1000 will be described with reference to FIG. 12. FIG. 12 illustrates a state that the edge of the sheet reaches the near portion region of the reference pin 105*a* (refer to FIG. 8) of the sheet introducing portion 103 and the sheet S rotates in the direction of the arrow Rv by deflection.

Here, the sheet S which is conveyed along the curved portion 27*a* of the conveying lower guide 27 and the curved portion of 103*b* of the sheet introducing portion 103 tends to be easily deflected to the sheet conveying surface. As described above, as for the relation of the height to the sheet conveying surface, the sheet conveying surface of the first conveying path portion FPa and the sheet conveying surface of the first conveying path portion FPb are located below the sheet conveying surface in the sheet introducing portion near-side edge portion 100KB of the reference guides 100.

The path intervals PT1 and PT5 in the first conveying path portions FPa and FPb have a width in the vertical direction in which the sheet can be sufficiently deflected to the lower side of the sheet conveying surface. That is, the first conveying path portions FPa and FPb are dented below the sheet introducing portion near-side edge portion 100KB of the reference guide 100.

Therefore, while the edge of the sheet is guided from the sheet introducing portion 103 to the reference pin 105*a*, the sheet S can be easily deflected downward in the first conveying path portions FPa and FPb. Accordingly, the edge of the sheet can be easily rotated in the direction of the arrow Rv.

When the sheet S can be easily deflected, force acting on the side edge of the sheet introducing portion by the elasticity of the sheet S can be reduced. Thus, according to the present embodiment, the edge of the sheet can be rotated in the Rv direction by an easy structure.

In the upstream side region opposed to the guiding surface 103*a* of the sheet introducing portion 103, an interval of path which is formed at the first conveying path portions FPa and FPb of the central side in the width direction is ensured larger than an interval of path which is formed at the sheet introducing portion near-side edge portion 100KB of the sheet introducing portion 103.

After passing through the guiding surface 103*a* of the sheet introducing portion 103, the sheet is guided by the inclined portion 100T which is inclined in the thickness direction and the inclined portion 27*c* so that the path interval becomes narrow. Then, in the downstream side region opposed to the reference guide 100*a*, the height of the second conveying path portion SPa which is the sheet conveying surface of the reference guide 100 and the second conveying path portion SPb in the conveying lower guide 27 become the same as the height of the sheet introducing portion near-side edge portion 100KB of the sheet introducing portion 103. Since such a structure is included, in the first conveying path portions FPa and FPb as described above, the sheet is guided by the inclined portion 100T and the inclined portion 27*c* so as to reduce the deflection when the sheet is deflected downward and the sheet reaches the pair of skew conveying rollers 101A. Therefore, position correction by the reference guide 100*a* of the sheet is performed without being affected by the deflection of the sheet formed at the first conveying path portions FPa and FPb, which is excellent in accuracy of position.

Figure 13A:
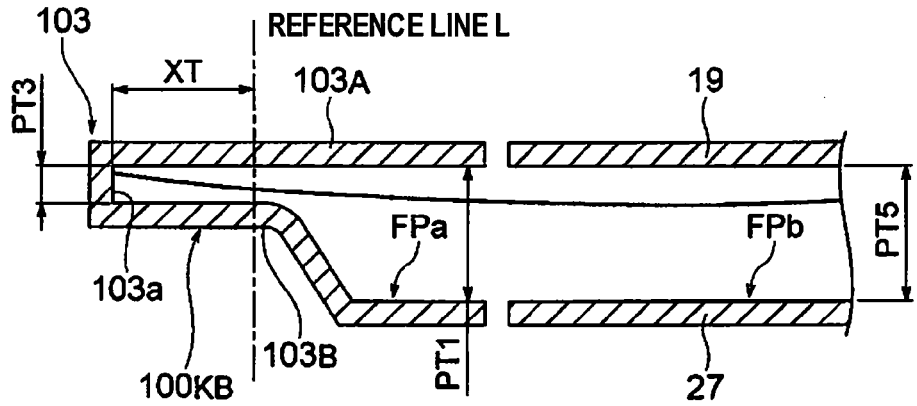
FIGS. 13A-C are diagrams describing lateral register correcting operation of the sheet in the lateral register correcting unit.
Figure 13B:
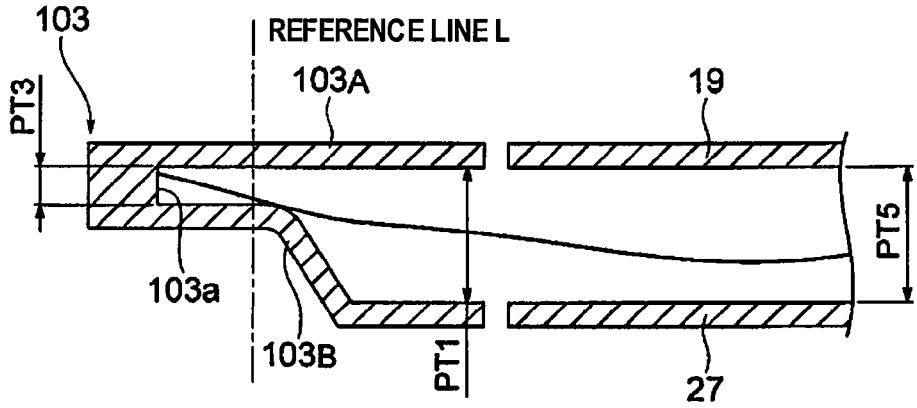
Figure 13C:
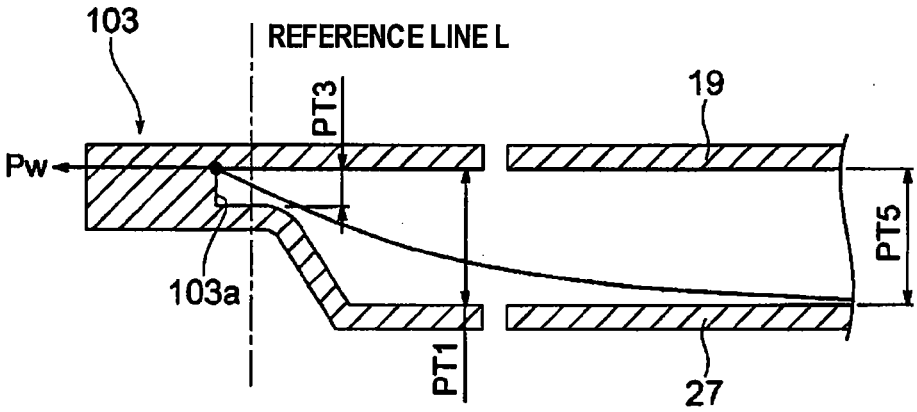

FIGS. 13A-C are diagrams describing lateral register correcting operation of the lateral register correcting unit 1000 according to the present embodiment. FIG. 13A illustrates a state of the sheet S when it is shifted by the width XT in the direction of the arrow –X and conveyed. FIGS. 13B and 13C illustrate a state that the sheet S which is shifted and conveyed moves in the sheet conveying direction and is guided to the reference line L.

In FIG. 13A, guide members 103A and 103B are opposed to each other and include the sheet introducing portion 103. In the present embodiment, an interval in the sheet thickness direction in the first conveying path portion FPa of guide members 103A and 103B is wide so that the first conveying path portion FPa of the sheet introducing portion 103 is dented below the sheet introducing portion near-side edge portion 100KB.

Here, as shown in FIGS. 13B and 13C, the deflection amount at the path intervals PT3 and PT5 of the sheet S is increased as the sheet S is conveyed downstream. As described above, this is because the path intervals PT3 and PT5 in the first conveying path portions FPa and FPb have a width in the vertical direction in which the sheet can be sufficiently deflected.

A force Pw acting on the sheet introducing portion 103 by the sheet side edge can be reduced by deflecting the sheet S easily in such a manner when the sheet S is shifted in the width direction in order to guide the sheet side edge to the reference line L by the width XT. As a result, scratching and wearing at the time of sliding of the sheet introducing portion 103 can be reduced when the duration of use becomes longer. Further, conveying resistance caused by sliding resistance to the sheet side edge and the sheet introducing portion 103 can be reduced.

Thus, according to the present embodiment, the sheet can be easily deflected, thereby allowing the edge of the sheet to rotate in the Rv direction easily. When the sheet S is shifted in the width direction, the force Pw acting on the sheet introducing portion 103 by the sheet side edge can be reduced. Scratching and wearing of the side edge of the sheet introducing portion when used for a long time as well as sliding resistance of the side edge of the sheet introducing portion can be reduced.

In the case where the path interval PT3 of the sheet introducing portion near-side edge portion 100KB of the reference guide 100 is wider, the sheet only near the reference pin is deflected as compared to the reference pin 105*b* when the drawing force of the sheet is acted by the pair of skew conveying rollers 101A as shown in FIG. 4. As a result, the sheet can be skew-fed. Therefore, the path interval PT3 of the sheet introducing portion near-side edge portion 100KB is set to a sufficiently narrow range.

Thus, in the first conveying path portions FPa and FPb opposed to the guiding surface 103*a* of the sheet introducing portion 103, the sheet is deflected and then the sheet is guided by the inclined portion 100T inclined in the thickness direction and the inclined portion 27*c* so that the path interval becomes narrow. Thereafter, in the downstream side region opposed to the reference guide 100*a*, the height of the second conveying path portion SPa which is the sheet conveying surface of the reference guide 100 and the second conveying path portion SPb in the conveying lower guide 27 become nearly the same as the height of the sheet introducing portion near-side edge portion 100KB of the sheet introducing portion 103.

In the present embodiment, the pair of skew conveying rollers 101A (skew conveying roller 101*a*) are disposed at the second conveying path portion SPa of the reference guide 100 as shown in FIG. 10.

Here, in the case where the pair of skew conveying rollers 101A are disposed at the first conveying path portion FPa which has a sufficiently wide path interval, the sheet is deflected between the pair of skew conveying rollers 101A and the reference surface 102 as shown in FIG. 4 when the sheet is drawn by the pair of skew conveying rollers 101A. In this case, the sheet S is shifted by only the deflected amount in the width direction and conveyed, which may cause skew feeding. Therefore, it is desirable to place the pair of skew conveying rollers 101A in the second conveying path portion SPa.

Since such a structure is included, in the first conveying path portions FPa and FPb as described above, the sheet is guided by the inclined portion 100T and the inclined portion 27*c* so as to reduce the deflection when the sheet is deflected downward and then the sheet reaches the pair of skew conveying rollers 101A. Therefore, position correction by the reference guide 100*a* of the sheet is performed without being affected by the deflection of the sheet formed at the first conveying path portions FPa and FPb, which is excellent in accuracy of position.

On the other hand, as described above, when the path difference of the paper in the height direction is caused in right and left in the width direction of the sheet of an outlet portion of the duplex unit 10, the sheet fed out from the duplex unit 10 may be skew-fed or may be shifted in the width direction. In this case, the sheet subjected to the lateral register correction by the lateral register correcting unit 1000 is skew-fed again at the outlet portion of the duplex unit 10 or shifted in the width direction and conveyed. For example, when the width of the path interval PT2 of the second conveying path portion SPa of the reference guide 100 is significantly different from the width of the path interval PT4 of the second conveying path portion SPb of the conveying lower guide 27, relative paper path difference in the height direction can be caused at both ends in the width direction of the sheet S in the outlet of the duplex unit.

Further, when relative height positions of the second conveying path portion side of the conveying lower guide 27 and the second conveying path portion side of the reference guide 100 in the outlet portion of the duplex unit 10 are significantly different, relative paper path difference in the height direction can be caused at both ends in the width direction of the sheet in the outlet of the duplex unit 10. When the width of the path interval PT2 of the second conveying path portion SPa of the reference guide 100 and the width of the path interval PT4 of the second conveying path portion SPb of the conveying lower guide 27 are sufficiently wide, the deflection amount at both ends in the width direction of the sheet S becomes larger in the outlet of the duplex unit. In this case, relative paper path difference in the height direction can be caused at both ends of the sheet.

Figure 14:
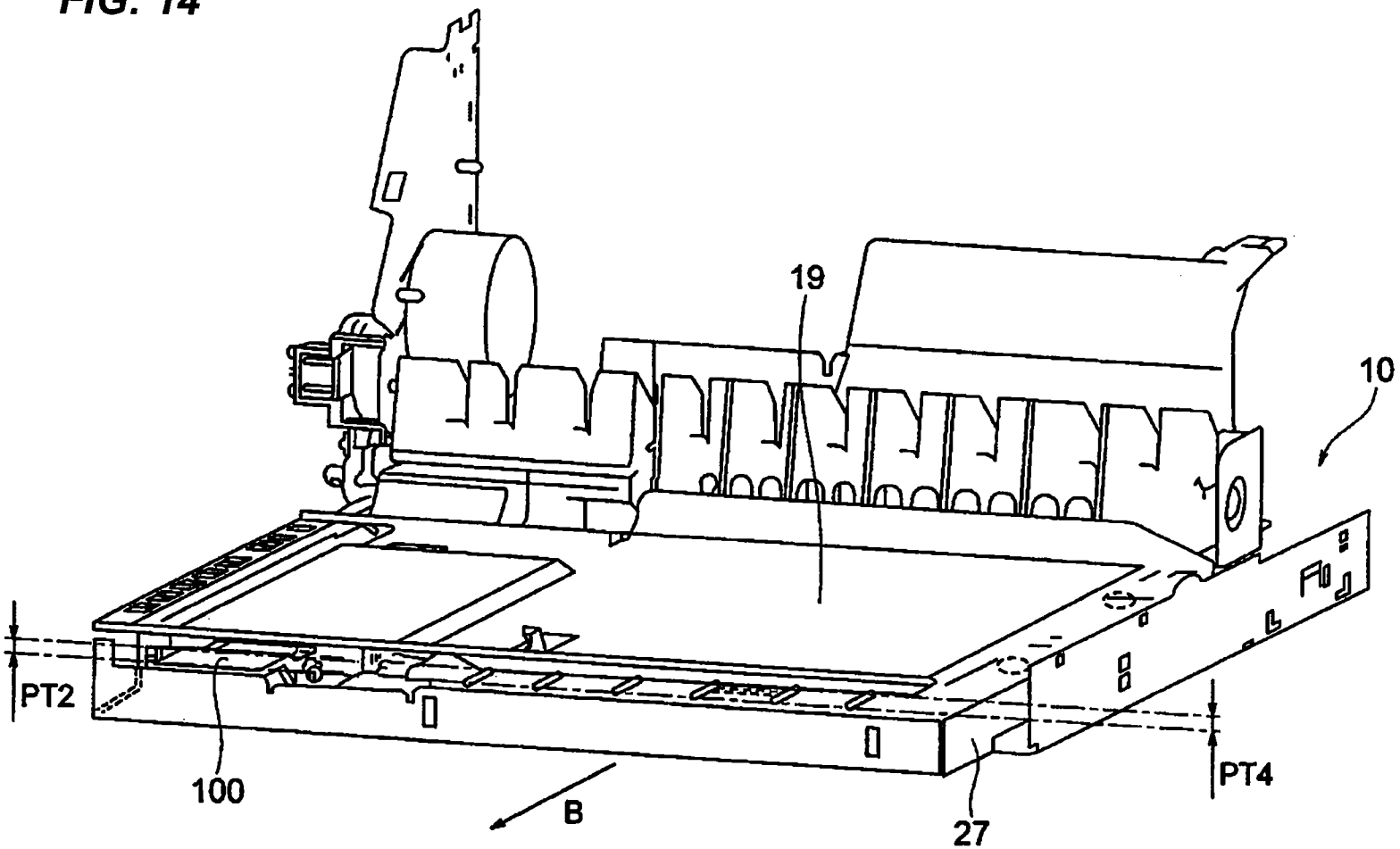
FIG. 14 is a view in the vicinity of the rail portion when the duplex unit is viewed from the upstream side.
Figure 15A:
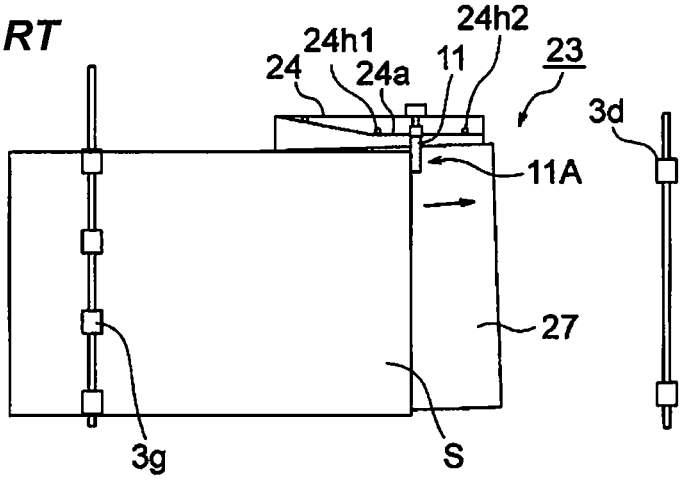
FIG. 15A PRIOR ART
FIG. 15 is a diagram illustrating the structure of a reconveying passage and lateral register correction as to a conventional sheet conveying apparatus.
Figure 15B:
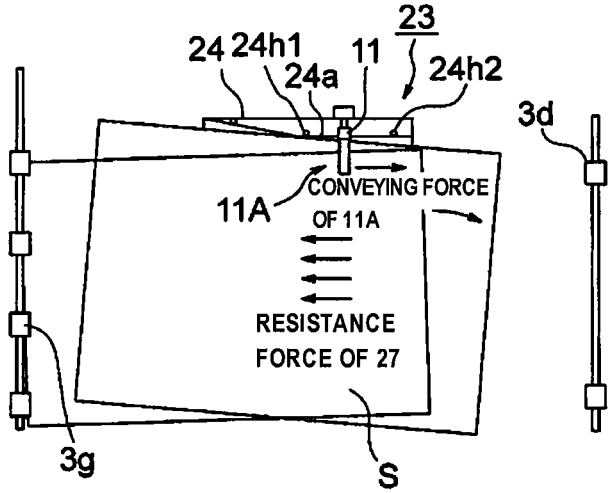
FIG. 15B PRIOR ART
Figure 15C:
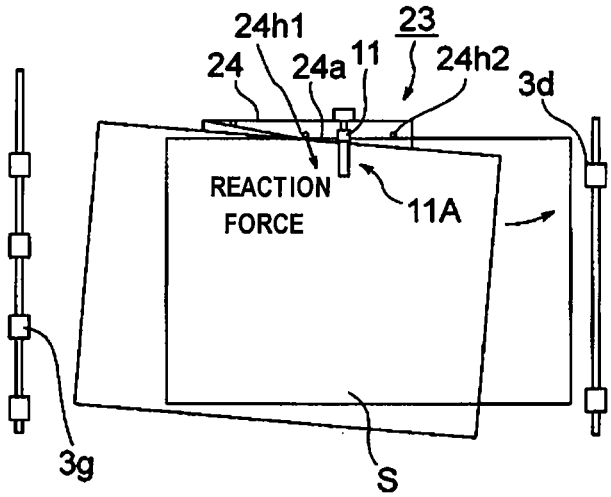
FIG. 15C PRIOR ART
Figure 16:
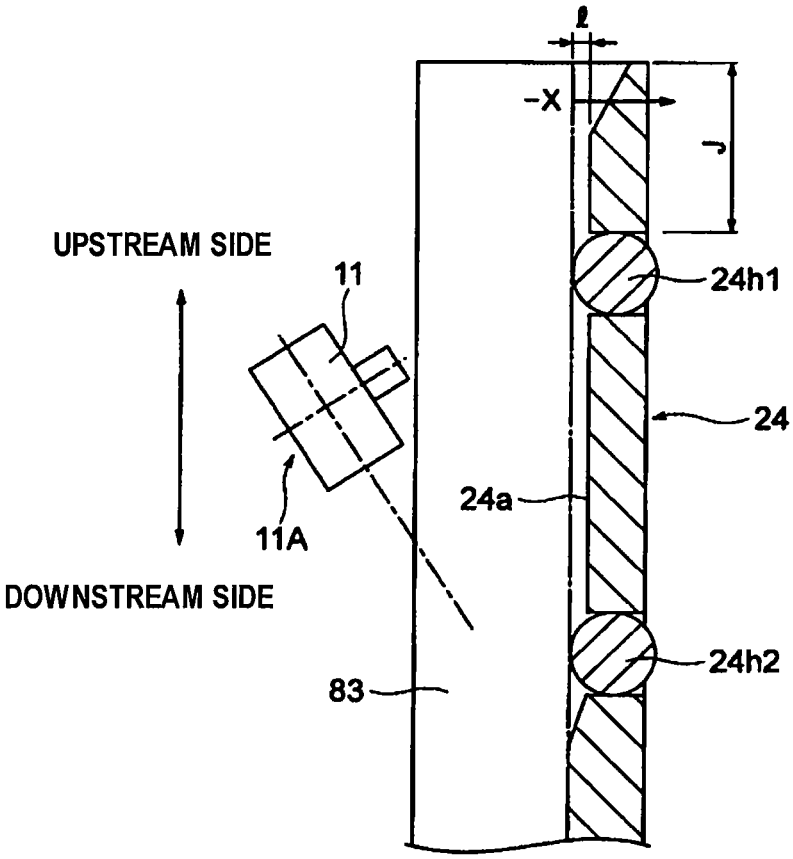
FIG. 16 PRIOR ART
FIG. 16 is a diagram illustrating the structure of the reconveying passage of another conventional sheet conveying apparatus.
Figure 17A:
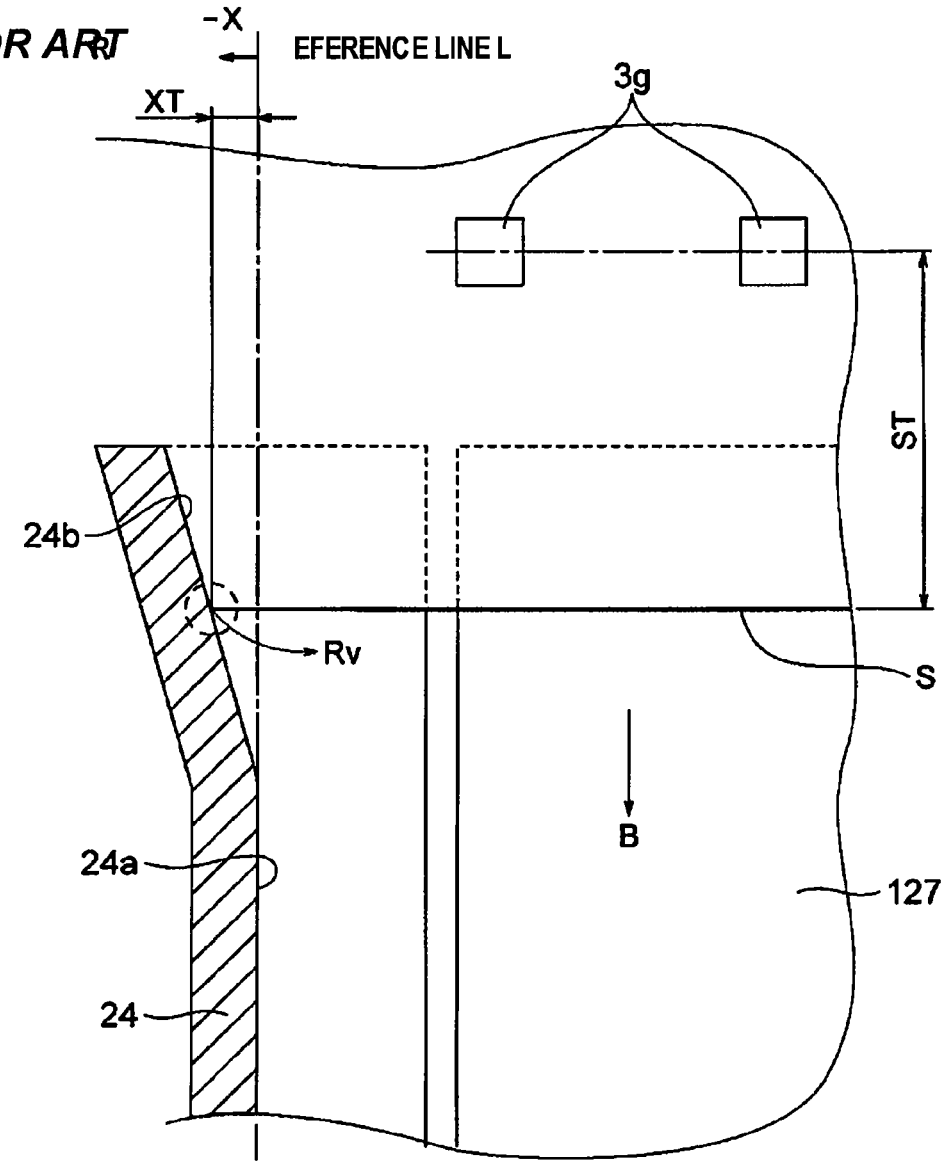
FIG. 17A PRIOR ART
FIG. 17 is a diagram describing a state when the sheet passes through the lateral register correcting portion of the conventional sheet conveying apparatus.
Figure 17B:
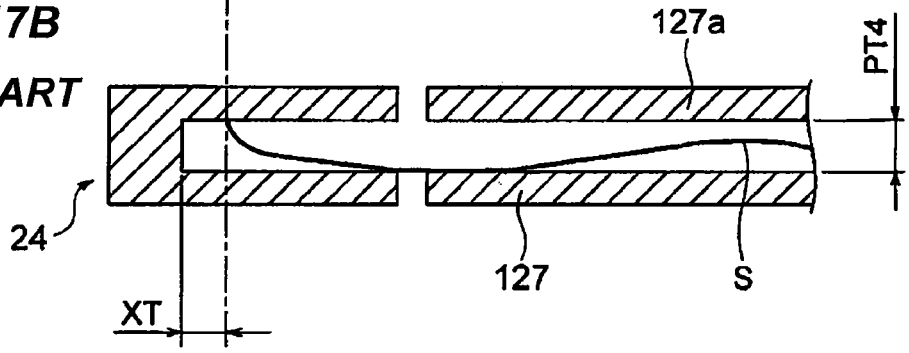
FIG. 17B PRIOR ART
Figure 18A:
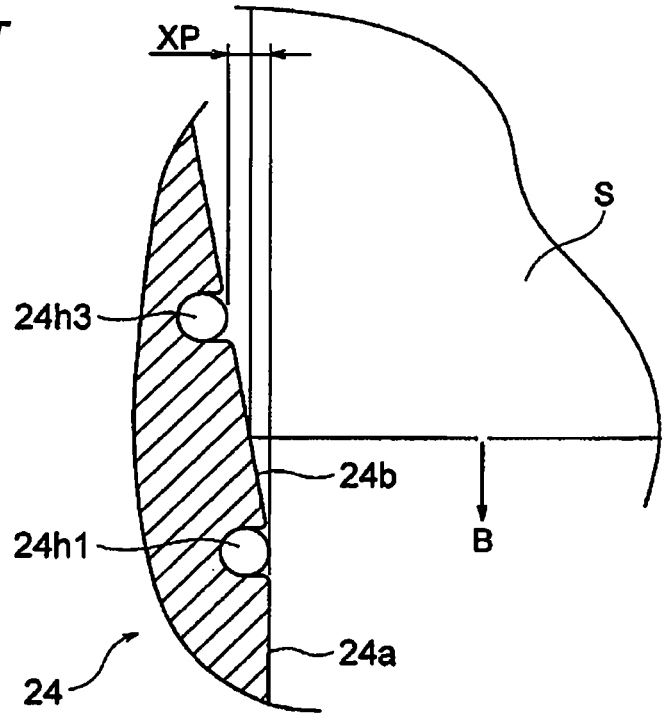
FIG. 18A PRIOR ART
FIG. 18 is a diagram describing a state when the sheet passes through another lateral register correcting portion of the conventional sheet conveying apparatus.
Figure 18B:
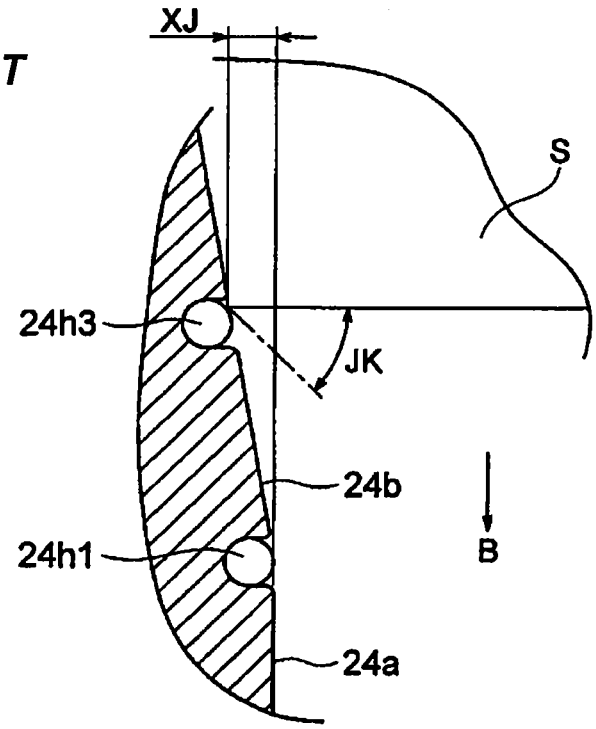
FIG. 18B PRIOR ART

In the present embodiment, as shown in FIG. 14, the path interval PT2 which is a width of the outlet portion of the duplex unit of the reference guide 100 and the path interval PT4 which is a width of the outlet portion including the conveying lower guide 27 and the conveying upper guide 19 are nearly matched in the height direction.

In other words, the guide undersurface of the reference guides 100 and the guiding surface of the conveying lower guide 27 are nearly matched in the height direction. The guide upper surface of the reference guide 100 and the guiding surface of the conveying upper guide 19 are nearly matched in the height direction. In the present embodiment, the intervals PT2 and PT4 in the second conveying path portions SPa and SPb in the outlet of the duplex unit are about several mm.

Thus, even if the sheet is deflected at the first conveying path portions FPa and FPb, the deflection amount at both ends in the sheet width direction in the outlet of the duplex unit can be reduced. Further, relative paper path difference at both ends of the sheet in the outlet portion of the duplex unit can be reduced. As a result, lateral register correction of the sheet can be performed reliably and the duplex unit which is formed by taking into consideration the durability and the conveying performance can be provided.

As described above, in the upstream side region opposed to the guiding surface 103*a* of the sheet introducing portion 103, the interval of path of the first conveying path portions FPa and FPb of the central side in the width direction is ensured larger than the interval of path which is formed at the sheet introducing portion near-side edge portion 100KB of the sheet introducing portion 103. In other words, the conveying lower guide 27 (first conveying path portion FPb) and the first conveying path portion FPa of the sheet introducing portion 103 are dented below the sheet introducing portion near-side edge portion 100KB. Thus, when the sheet abuts against the guiding surface 103*a* of the sheet introducing portion 103, the end portion of the side of the guiding surface of the sheet can be deflected. As a result, shifting in the horizontal direction of the sheet can be corrected without causing paper jams.

In the present embodiment, the first conveying path portions FPa and FPb which allow the sheet to be deflected downward are provided at the conveying lower guide 27 so that the sheet is conveyed to the lateral register correcting unit while it moves along the curved portion 27*a* of the conveying lower guide 27 and the curved portion 103*b* of the sheet introducing portion 103.

However, the present invention is not limited thereto. A dent which upwardly deflects the sheet to the conveying upper guide 19 may be provided depending on the direction of the curvature of the sheet introducing portion. Further, the dent may be provided at both of the conveying lower guide 27 and the conveying upper guide 19. Although the present embodiment has been described with the case of the duplex unit as an example, the present invention can be applied to other sheet conveying apparatuses which perform the lateral register correction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-284447, filed Oct. 31, 2007, which is hereby incorporated by reference herein in its entirety.

What is claimed is:

1. A sheet conveying apparatus comprising:

a reference surface that is elongated in a sheet conveying direction and against which a side edge of a sheet abuts;

an inclined surface which is provided upstream in the sheet conveying direction of the reference surface and which is inclined in a width direction intersecting with the sheet conveying direction so that an edge of the sheet is guided, wherein the inclined surface intersects the reference surface at an intersection;

a sheet guide portion which is provided along the reference surface and the inclined surface and which has an upper portion and a lower portion, wherein the sheet guide portion guides a sheet between the upper portion and the lower portion;

an oblique conveying unit which skew conveys the sheet so as to abut the side edge of the sheet against the reference surface, and a sheet passage portion which has an upper guide and a lower guide, wherein a sheet passes between the upper guide and the lower guide;

wherein the sheet passage portion has an upstream area provided at a position corresponding to the inclined surface in the sheet conveying direction and a downstream area provided at a position corresponding to the reference surface in the sheet conveying direction;

wherein a gap in the upstream area between the upper guide and the lower guide in a thickness direction of the sheet is wider than a gap between the upper portion and the lower portion of the sheet guide portion in the thickness direction of the sheet, wherein a gap in the downstream area between the upper guide and the lower guide in the thickness direction of the sheet is narrower than the gap in the upstream area between the upper guide and the lower guide in the thickness direction of the sheet;

wherein a position of an upstream edge of the downstream area in the sheet conveying direction is provided downstream of the intersection in the sheet conveying direction.

2. The sheet conveying apparatus according to claim 1, wherein the gap between the upper portion and the lower portion of the sheet guide portion in the thickness direction of the sheet is equal to the gap between the upper guide and the lower guide in the downstream area in the thickness direction of the sheet.

3. The sheet conveying apparatus according to claim 1 comprising a pin or a metal plate which is provided between the reference surface and the inclined surface.

4. An image forming apparatus comprising:

an image forming portion which forms an image on the sheet; and the sheet conveying apparatus according to claim 1.

5. The image forming apparatus according to claim 4, wherein the sheet conveying apparatus further includes a duplex unit, wherein a sheet on which an image is formed on one surface at the image forming portion is returned to the image forming portion in order to form images on a back surface of the sheet.

6. The image forming apparatus to claim 1, the position of the upstream edge of the downstream area in the sheet conveying direction is provided upstream of the oblique conveying unit in the sheet conveying direction.

* * * * *